US012667233B2

(12) United States Patent
Griffith et al.

(10) Patent No.: US 12,667,233 B2
(45) Date of Patent: Jun. 30, 2026

(54) HANDHELD EXTRACTION CLEANER

(71) Applicant: BISSELL Inc., Grand Rapids, MI (US)

(72) Inventors: Aaron Griffith, Grand Rapids, MI (US); Victoria J. Royale, Comstock Park, MI (US); Derek Everett Smith, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 245 days.

(21) Appl. No.: 18/760,335

(22) Filed: Jul. 1, 2024

(65) Prior Publication Data

US 2024/0349960 A1 Oct. 24, 2024

Related U.S. Application Data

(63) Continuation of application No. 18/222,549, filed on Jul. 17, 2023, now Pat. No. 12,053,138, which is a continuation of application No. 17/985,950, filed on Nov. 14, 2022, now Pat. No. 11,793,378.

(60) Provisional application No. 63/280,176, filed on Nov. 17, 2021.

(51) Int. Cl.

| | |
|---|---|
| ***A47L 7/00*** | (2006.01) |
| ***A47L 5/24*** | (2006.01) |
| ***A47L 9/06*** | (2006.01) |
| ***A47L 9/32*** | (2006.01) |

(52) U.S. Cl.

CPC ..... *A47L 7/0023* (2013.01); *A47L 7/0014* (2013.01); *A47L 9/0606* (2013.01); *A47L 9/322* (2013.01); *A47L 5/24* (2013.01)

(58) Field of Classification Search

CPC .... A47L 7/0023; A47L 7/0014; A47L 9/0606; A47L 9/322; A47L 5/24; A47L 9/0673

See application file for complete search history.

(56) References Cited

U.S. PATENT DOCUMENTS

| | | | | |
|---|---|---|---|---|
| 4,776,058 | A | 10/1988 | Garner et al. | |
| 4,788,738 | A | 12/1988 | Monson et al. | |
| 5,367,740 | A | 11/1994 | McCray | |
| 5,386,612 | A * | 2/1995 | Sham | A47L 9/0613 15/367 |
| 5,507,068 | A | 4/1996 | Fan et al. | |
| 5,599,401 | A | 2/1997 | Brosky et al. | |
| 6,125,498 | A | 10/2000 | Roberts et al. | |
| 6,189,178 | B1 | 2/2001 | Roberts | |
| 6,347,428 | B1 | 2/2002 | Shimko et al. | |
| 6,550,098 | B2 | 4/2003 | Roberts | |
| 6,658,693 | B1 | 12/2003 | Reed, Jr. | |
| 6,968,593 | B1 | 11/2005 | Lenkiewicz et al. | |

(Continued)

FOREIGN PATENT DOCUMENTS

| | | |
|---|---|---|
| CN | 101756673 | 6/2010 |
| CN | 201564417 | 9/2010 |

(Continued)

*Primary Examiner* — Andrew A Horton

(74) *Attorney, Agent, or Firm* — Warner Norcross + Judd LLP

(57) ABSTRACT

A handheld extraction cleaner includes a unitary body provided with a carry handle, and further provided with a supply tank, a suction nozzle, a recovery tank, and a suction source, all of which are carried by the unitary body. In one aspect, the suction nozzle includes a cleaning angle guide skid to orient the extraction cleaner at an optimal cleaning angle.

20 Claims, 17 Drawing Sheets

(56) References Cited

U.S. PATENT DOCUMENTS

| | | | |
|---|---|---|---|
| 7,225,503 | B1 | 6/2007 | Lenkiewicz et al. |
| 8,015,662 | B2 | 9/2011 | Rosenzweig et al. |
| 8,677,559 | B2 | 3/2014 | Hollis |
| 8,801,861 | B2 | 8/2014 | Cobabe et al. |
| 9,326,655 | B2 | 5/2016 | Call |
| 10,258,207 | B2 | 4/2019 | Stewen et al. |
| 10,624,515 | B2 | 4/2020 | Bloemendaal et al. |
| 2009/0044359 | A1 | 2/2009 | Park et al. |
| 2015/0174620 | A1 | 6/2015 | Liang |
| 2019/0174982 | A1 | 6/2019 | Santiago |
| 2021/0137333 | A1 | 5/2021 | Jones |
| 2021/0169284 | A1 | 6/2021 | Royale |
| 2022/0183520 | A1 | 6/2022 | Reeder et al. |

FOREIGN PATENT DOCUMENTS

| | | |
|---|---|---|
| CN | 209203141 | 8/2019 |
| CN | 209499604 | 10/2019 |
| CN | 211460025 | 9/2020 |
| CN | 211484354 | 9/2020 |
| CN | 112741550 | 5/2021 |
| CN | 214906401 | 11/2021 |
| CN | 216495087 | 5/2022 |
| CZ | 12317 | 6/2002 |
| DE | 202017106417 | 1/2018 |
| EP | 3824786 | 5/2021 |
| EP | 3831261 | 6/2021 |
| FR | 2871023 | 12/2005 |
| GB | 2331919 | 6/1999 |
| JP | 3127062 | 11/2006 |
| JP | 2017136303 | 8/2017 |
| KR | 20050123221 | 12/2005 |
| KR | 100602245 | 7/2006 |
| KR | 20060128098 | 12/2006 |
| KR | 100671834 | 1/2007 |
| KR | 20090011929 | 2/2009 |
| KR | 102184064 | 12/2020 |
| WO | 2009086892 | 7/2009 |
| WO | 2015007327 | 1/2015 |
| WO | 2016029967 | 3/2016 |
| WO | 2017092832 | 6/2017 |
| WO | 2017108089 | 6/2017 |
| WO | 2019053000 | 3/2019 |
| WO | 2021087668 | 5/2021 |

* cited by examiner

HANDHELD EXTRACTION CLEANER

CROSS-REFERENCE TO RELATED APPLICATION(S)

This application is a continuation of U.S. application Ser. No. 18/222,549, filed Jul. 17, 2023, which is a continuation of U.S. application Ser. No. 17/985,950, filed Nov. 14, 2022, which claims the benefit of U.S. Provisional Application No. 63/280,176, filed Nov. 17, 2021, all of which are incorporated herein by reference in their entirety.

BACKGROUND

Extraction cleaners can be embodied as upright units or portable, hand-carriable units. Handheld extraction cleaners include a cleaning solution supply tank and a recovery tank. These extraction cleaners typically have a suction source including a vacuum motor that powers an impeller to create low pressure on one side of the impeller and higher pressure on the other side thereof. The recovery tank is typically positioned between the low pressure side of the impeller and a suction nozzle to remove fluid from a surface and deposit it in the recovery tank.

A noted problem with handheld extraction cleaners is that, due to their compact and portable nature, space is at a premium. Accordingly, the supply tank and recovery tank necessarily have a limited capacity. Agitators may be undersized or eliminated altogether. It is also often necessary to hold the extraction cleaner at a particular angle to minimize the likelihood of liquid entering the suction source or leaking out of the suction nozzle.

BRIEF SUMMARY

Aspects of the disclosure relate to a handheld extraction cleaner having a fluid delivery system for storing cleaning fluid and delivering the cleaning fluid to the surface to be cleaned and a recovery system for removing the spent cleaning fluid and debris from the surface to be cleaned and storing the spent cleaning fluid and debris.

According to one aspect of the disclosure, the handheld extraction cleaner includes a unitary body including a carry handle, a fluid delivery system comprising a supply tank on the unitary body and at least one fluid distributor, a recovery system comprising a working air path through the unitary body, a suction nozzle comprising a nozzle inlet defining an inlet to the working air path, a suction source in fluid communication with the suction nozzle, and a recovery tank on the unitary body, an agitator provided on a bottom of the unitary body, the agitator disposed rearwardly of the suction nozzle and forwardly of the recovery tank, and a cleaning angle guide skid to orient the extraction cleaner at a predetermined cleaning angle for extraction with respect to a surface to be cleaned.

According to another aspect of the disclosure, the handheld extraction cleaner includes a supply tank, a suction nozzle, a recovery tank, and a vacuum motor, all of which are carried by a unitary body having a carry handle, where the suction nozzle comprises a cleaning angle guide skid to orient the extraction cleaner at a predetermined cleaning angle for efficient extraction with respect to a surface to be cleaned.

In these and other embodiments, the cleaning angle guide skid can include a front ski and side skis behind the front ski, the front ski extending across a front of the suction nozzle and substantially the width of a nozzle inlet of the suction nozzle, and the side skis extending rearwardly of the nozzle inlet and disposed on either side of an agitation element of a brush carried by the unitary body.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The invention relates generally to extraction cleaners, and more particularly to a portable, handheld extraction cleaner which applies cleaning fluid to a surface and then extracts the applied fluid therefrom.

Figure 1:
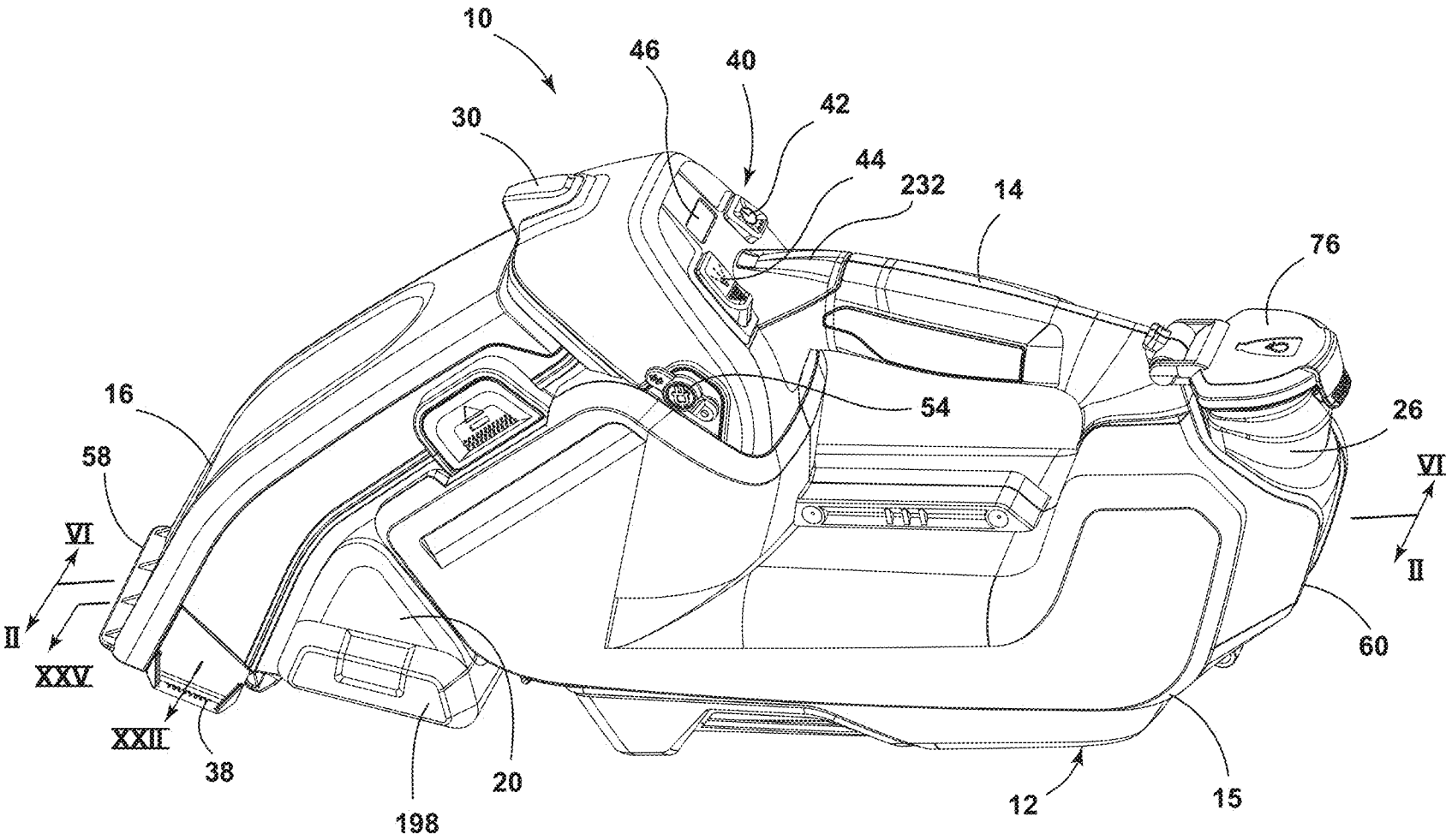
FIG. 1 is a perspective view of a handheld extraction cleaner according to one aspect of the disclosure.

FIG. 1 is a perspective view of a handheld extraction cleaner 10 according to one embodiment of the disclosure. As illustrated herein, the extraction cleaner 10 is adapted to be handheld and portable, and can be easily carried or conveyed by hand. The hand-carriable extraction cleaner 10 can have a unitary body 12 provided with a carry handle 14 attached to the unitary body 12, and is small enough to be transported by one user (i.e. one person) to the area to be cleaned.

For purposes of description related to the figures, the terms "upper," "lower," "right," "left," "rear," "front," "vertical," "horizontal," "inner," "outer," and derivatives thereof shall relate to the extraction cleaner 10 as oriented in FIG. 1 from the perspective of a user behind the extraction cleaner 10, which defines a rear end of the extraction cleaner 10, and carrying the extraction cleaner 10 by the handle 14, which defines an upper end of the extraction cleaner 10. When used in referring to a direction, the term "longitudinal" refers to a direction generally extending along the length of the extraction cleaner 10, between a forward end 58 and a rearward end 60 of the housing 15, and the terms "transverse" or "lateral" refer to a direction generally perpendicular to the longitudinal direction. However, it is to be understood that the invention may assume various alternative orientations, except where expressly specified to the contrary. The use of directional terms should not be interpreted to limit the invention to any specific orientation.

The unitary body 12 can include a housing 15 that carries various components and functional systems of the extraction cleaner 10, including a fluid delivery system for storing cleaning fluid and delivering the cleaning fluid to the surface to be cleaned and a recovery system removing the spent cleaning fluid and debris from the surface to be cleaned and storing the spent cleaning fluid and debris. In being carried by the unitary body 12 or housing 15 of the unitary body 12, the various components and functional systems are conveyed along with the body 12 as it is transported by the user to or from an area to be cleaned and during operation. Such components and systems can be removable or non-removable from the body 12 or housing 15. The term "debris" as used herein may include dirt, dust, soil, hair, and other debris, unless otherwise noted. The term "cleaning fluid" as used herein primarily encompasses liquids, and may include steam unless otherwise noted.

Figure 2:
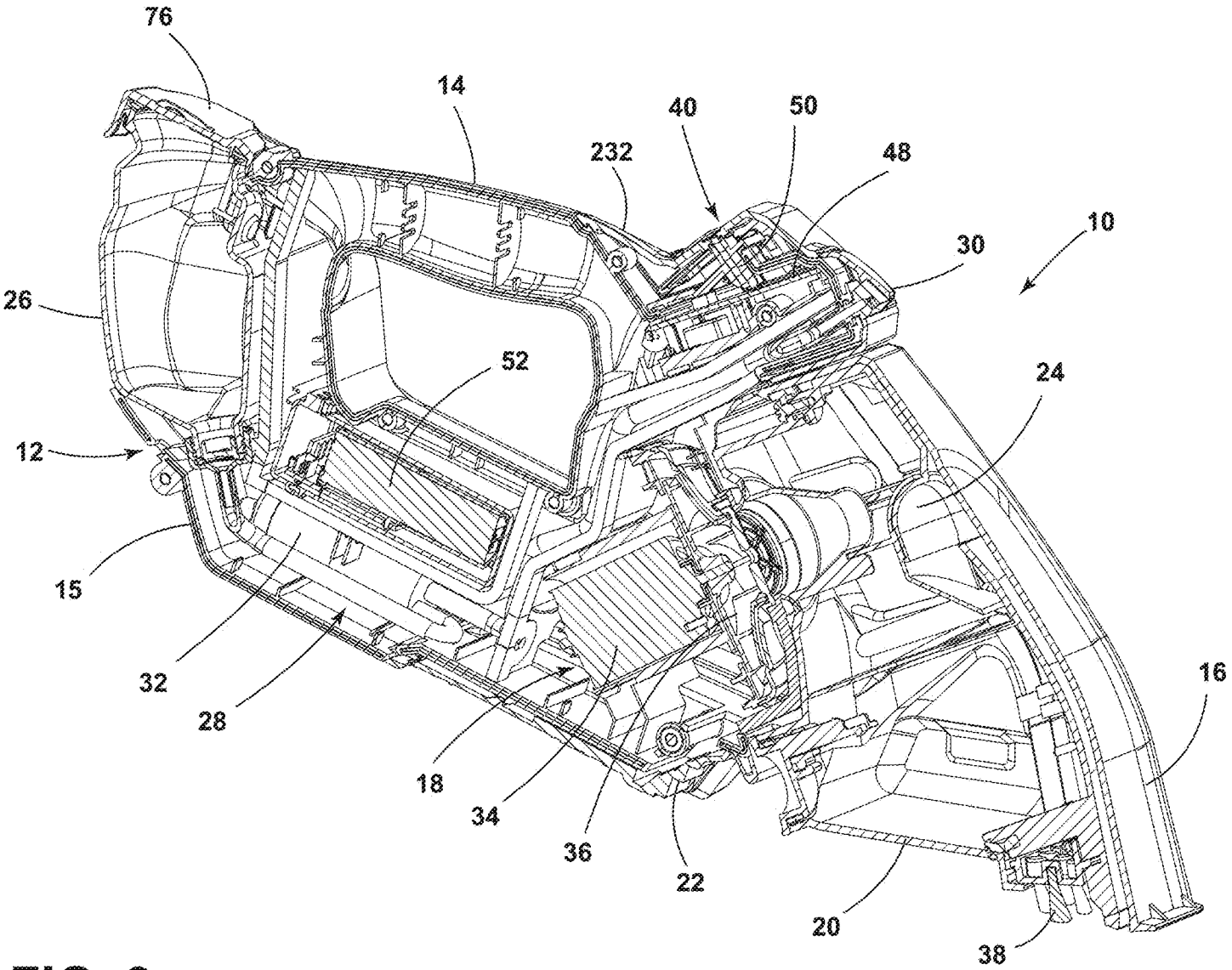
FIG. 2 is a cross-sectional perspective view of the handheld extraction cleaner, taken through line II-II of FIG. 1.

Referring additionally to FIG. 2, the recovery system can include a working air path through the body 12, and may include a dirty air inlet and a clean air outlet. The working air path can be formed by, among other elements, a suction nozzle 16 defining the dirty air inlet, a suction source 18 in fluid communication with the suction nozzle 16 for generating a working air stream, a recovery tank 20 for separating and collecting fluid and debris from the working airstream for later disposal, and exhaust vents 22 in the housing defining the clean air outlet. The recovery system can further include a separator 24 for separating liquid and entrained debris from the working airstream. The separator 24 can be formed in a portion of the recovery tank 20, or, as illustrated herein, can be separate from the recovery tank 20. The separated fluid and debris can be collected in the recovery tank 20.

The fluid delivery system can include a supply reservoir or supply tank 26 for storing a supply of fluid. The fluid can comprise one or more of any suitable cleaning fluids, including, but not limited to, water, compositions, concentrated detergent, diluted detergent, etc., or mixtures thereof. For example, the fluid can comprise a mixture of water and concentrated detergent.

The fluid delivery system can include a flow control system 28 for controlling the flow of fluid from the supply tank 26 to at least one fluid distributor 30. In one embodiment, described in further detail below, the flow control system 28 of the fluid delivery system can comprise a pump 32, which pressurizes the system. Optionally, a heater (not shown) can be provided for heating the cleaning fluid prior to delivering the cleaning fluid to the surface to be cleaned. In yet another example, cleaning fluid can be heated using exhaust air from a motor-cooling pathway for the suction source 18.

The suction source 18, which may be a motor/fan assembly, is provided in fluid communication with the suction nozzle 16 via the separator 24. As shown, the motor/fan assembly includes a vacuum motor 34 and a fan 36 driven by the vacuum motor 34. An inlet of the fan 36 is in fluid communication with air outlet of the separator 24.

An agitator can be provided adjacent to the suction nozzle 16 for agitating the surface to be cleaned so that the debris is more easily ingested into the suction nozzle 16. As shown, the agitator comprises a brush 38. The brush 38 can be provided at a forward portion of the unitary body 12, rearward of the suction nozzle 16. The brush 38 is stationary, i.e. fixedly mounted and non-rotating. In another embodiment, the agitator for the handheld extraction cleaner 10 can comprise a powered, rotating brushroll.

Referring to FIG. 1, the extraction cleaner 10 can include at least one user interface (UI) 40 through which a user can interact with the extraction cleaner 10 to operate and control the extraction cleaner 10. The UI 40 can be electrically coupled with electrical components, including, but not limited to, circuitry electrically connected to various components of the fluid delivery and collection systems of the extraction cleaner 10. The UI 40 can include one or more input controls 42, 44, which can comprise a button, trigger, toggle, key, switch, touch screen, or the like, or any combination thereof. The UI 40 can include at least one status indicator 46 that conveys information about an event or change related to the operation of the extraction cleaner 10 or its operating environment, including operational status, diagnostic information, and/or various error and fault codes.

The UI 40 can be provided on the body 12 at a forward end of the carry handle 14. The input controls 42, 44 can conveniently be provided above the handle 14, at a forward end thereof, for operation of the controls by a thumb of the user's hand that is gripping the carry handle 14. Likewise, the status indicator 46 can be provided above the handle 14, at a forward end thereof so that a user can conveniently see the status indicator 46 in a typical operational position of the extraction cleaner 10.

In the embodiment shown herein, one input control 42 is a power input control that controls the supply of power to the vacuum motor 34, another input control 44 is a dispensing input control that controls the supply of power to the pump 32 or otherwise controls dispensing of cleaning fluid via the flow control system 28. Thus, suction and fluid delivery can be implemented individually, or in combination, by operation of the input controls 42, 44. The power input control 42 can comprise a toggle switch that allows the user to change the power setting between "off" and "on" states. The fluid input control 44 can comprise a momentary switch that is only engaged while it is being depressed.

In the embodiment shown, the input controls 42, 44 can comprise buttons in register with switches on a printed circuit board (PCB) 48 (FIG. 2). The PCB 48 can include one or more LEDs that illuminate the status indicator 46, for example via at least one light pipe 50.

Electrical power can be provided by a source of mains electricity or by a battery or battery pack. In the present embodiment, the extraction cleaner 10 comprises a rechargeable battery 52. The status indicator 46 can display a battery life or charge status of the battery 52. In another exemplary arrangement, the battery 52 can comprise a user replaceable battery. In yet another embodiment, the extraction cleaner 10 can comprise a power cord that is pluggable into a household outlet for corded operation.

With a rechargeable battery 52, a charging port 54 can be provided on the housing 15 and can be electrically coupled with the battery 52. In the illustrated embodiment, the charging port 54 is provided on one side of the body 12, at a forward end of the carry handle 14 and below the UI 40. A recharging cable (not shown) couples with the charging port 54 and can be plugged into a suitable electrical outlet for recharging the battery 52. In an alternative embodiment, the extraction cleaner 10 can have charging contacts on the housing 15, and a docking station (not shown) can be provided for docking the extraction cleaner 10 for recharging the battery 52.

Figure 3:
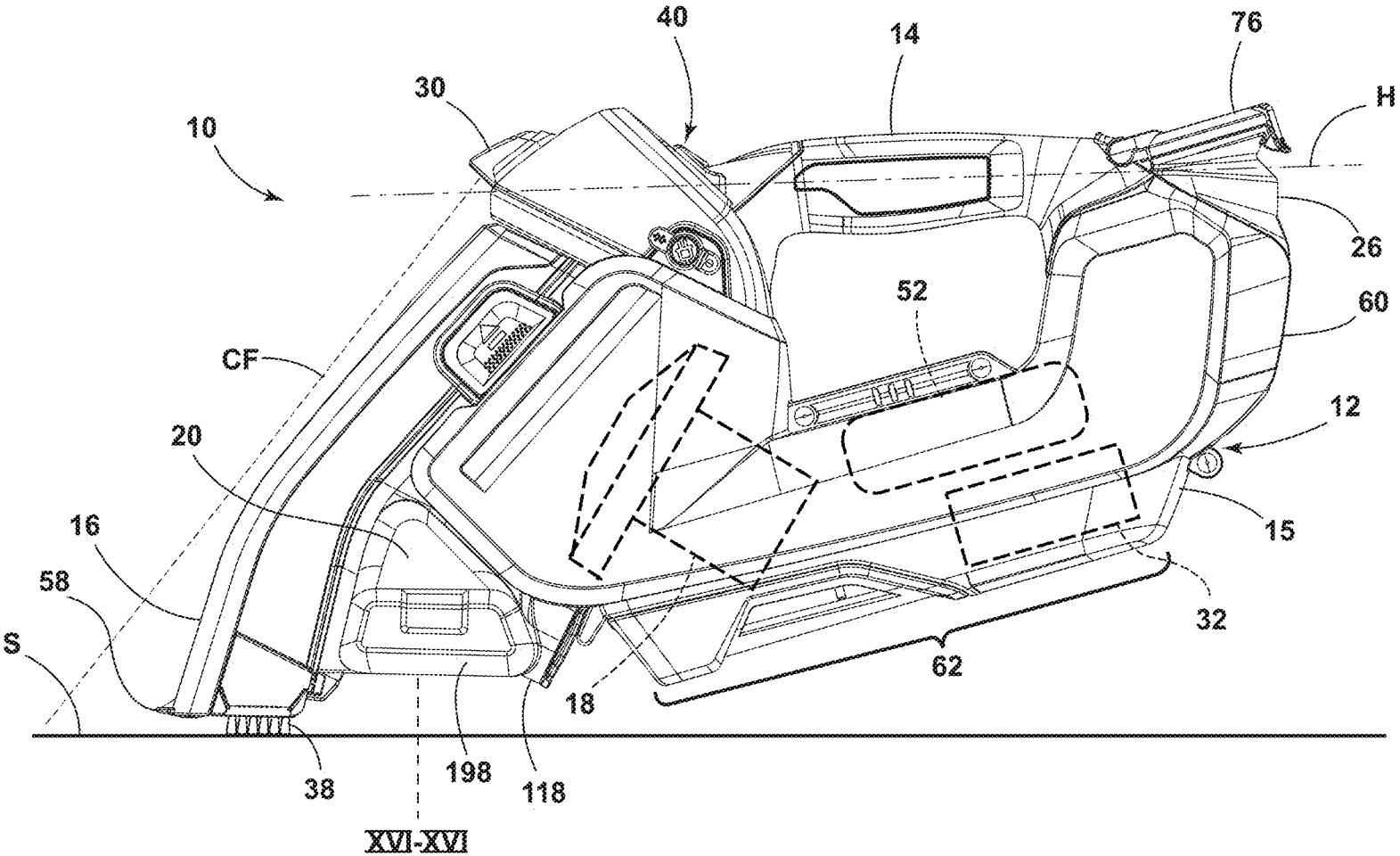
FIG. 3 is a side view of the handheld extraction cleaner in one example of a normal use position.

FIG. 3 is a side view of the handheld extraction cleaner 10 from FIGS. 1-2. The suction nozzle 16 is disposed at a forward end 58 of the body 12 while the supply tank 26, is disposed at a rearward end 60 of the body 12. The recovery tank 20 can be disposed on the housing 15 behind the suction nozzle 16 and in front of the suction source 18, shown in phantom line in FIG. 3. The battery 52, shown in phantom line in FIG. 3 can be disposed forwardly of the supply tank 26 and behind the suction source 18. The pump 32, shown in phantom line in FIG. 3, is disposed below the battery 52, and also behind the suction source 18. The carry handle 14 extends in the longitudinal direction between the UI 40 and the supply tank 26, and is disposed above the battery 52 and pump 32. The carry handle 14 includes a hand grip portion and a finger receiving area, which can be a closed volume, e.g. a closed loop handgrip. The majority of the carry handle 14 and the closed volume can be disposed behind the suction source 18. This arrangement of component parts of the extraction cleaner 10 offers a compact unit with a balanced weight-in-hand for the user, and a comfortable carrying and operational position. Other arrangements of component parts for the extraction cleaner 10 are possible.

In FIG. 3, the handheld extraction cleaner 10 is shown in one example of an operative or normal use position relative to a surface S to be cleaned. In the operative or normal use position, the extraction cleaner 10 is held with the forward end 58, particularly the suction nozzle 16 and brush 38, against the surface to be cleaned. The user may hold and manipulate the cleaner 10 via the carry handle 14. With the suction source 18, which can constitute the heaviest component of the extraction cleaner 10, disposed between the carry handle 14 and the forward end 58, more of the weight of the cleaner 10 can be supported by the surface S to cleaned, and less by the user.

The carry handle 14 may define a handle axis H along which the carry handle 14 is longitudinally extended. In the operative or normal use position, the handle axis H may be generally horizontal, or inclined from the horizontal, with "horizontal" being defined as parallel to the surface to be cleaned S. Having a substantially horizontal handle axis H positions the user's hand and wrist in an ergonomic position with more grip strength for holding the extraction cleaner 10 at an optimal cleaning angle.

The handheld extraction cleaner 10 can rest in a stable manner on the surface S in a horizontal position, without leakage from either tank 20, 26. In a self-standing or at rest position, the extraction cleaner 10 can be supported on a substantially flat resting surface 62 on a bottom of the body 12. With the resting surface 62 lying on surface to be cleaned S, the forward end 58 is supported away from the surface S. A user can therefore set the extraction cleaner 10 down in a stable position, upon a shelf or a countertop, for example, without having the suction nozzle 16 or brush 38 in contact with the surface S, and any residual fluid or dirt on the brush 38 will not transfer to the surface S. Heavy components (relative to the weight of other components of the cleaner 10) such as the pump 32 and battery 52 can be disposed above the resting surface 62, which increases stability in the horizontal position.

It is noted that, while the extraction cleaner 10 is shown and described in FIG. 3 in relation to a horizontal surface S to be cleaned, the extraction cleaner 10 may also be used to clean angled surfaces, such as stairs, upholstered furniture, car seats, and the like. Therefore, it is understood that various use orientations are possible.

Figure 4:
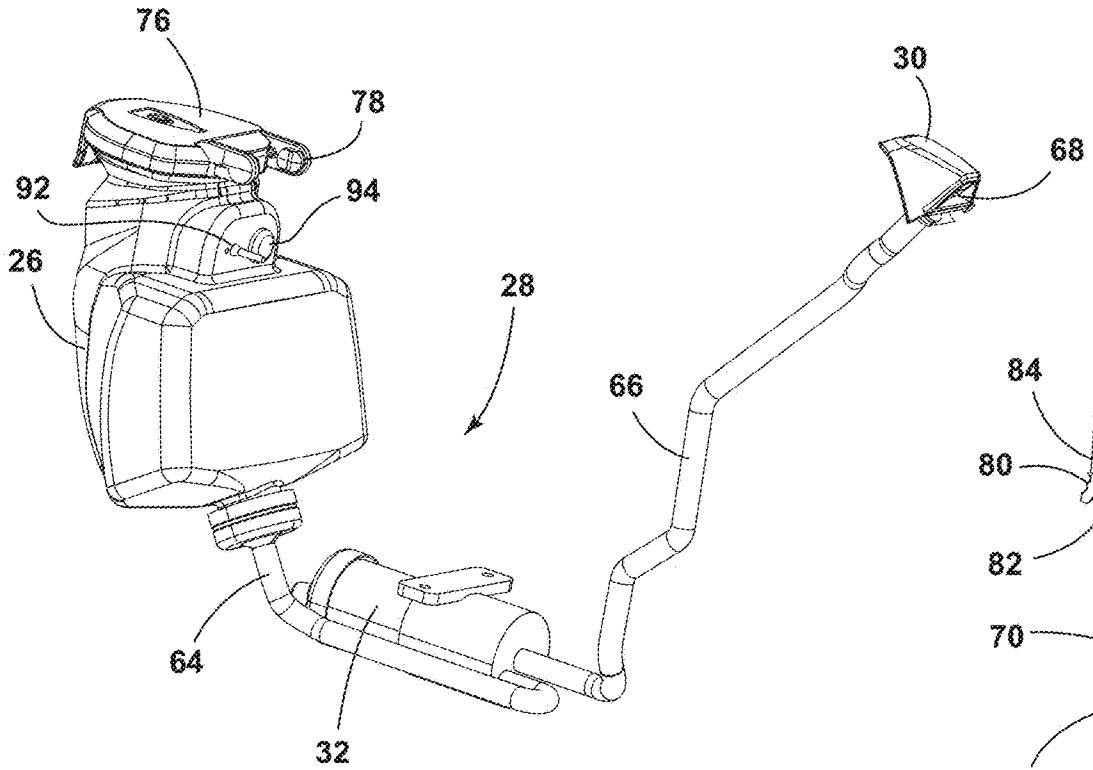
FIG. 4 is a view showing a fluid delivery system of the handheld extraction cleaner, with components of the fluid delivery system shown in isolation, the fluid delivery system including a supply tank.

FIG. 4 is a schematic view of the fluid delivery system of the handheld extraction cleaner 10, shown in isolation from the other components of the cleaner 10. As discussed above, the fluid delivery system illustrated herein includes the supply tank 26, the pump 32, the fluid distributor 30, and optionally additional conduits, ducts, tubing, hoses, connectors, etc. fluidly coupling the components of the fluid delivery system together and providing a supply path from the tank 26 to the fluid distributor 30. For example, a first conduit 64 can connect an outlet of the supply tank 26 with an inlet of the pump 32 and a second conduit 66 can connect an outlet of the pump 32 with an inlet of the fluid distributor 30. The conduits 64, 66 can comprise flexible tubing as shown in FIG. 4, but it is understood that any of the conduits can comprise molded rigid conduits, or a combination of conduits, ducts, tubing, hoses, connectors, etc.

In one example, the pump 32 can be a centrifugal pump. In another example, the pump 32 can be a diaphragm or membrane pump. In still another example, the pump 32 can be a manually actuated spray pump. In yet another configuration of the fluid delivery system, the pump 32 can be eliminated and the flow control system 28 can comprise a gravity-feed system having a valve fluidly coupled with an outlet of the supply tank 26, whereby when valve is open, fluid will flow under the force of gravity to the distributor 30. However, the use of a pump offers the advantage of orienting the supply tank 26 and fluid distributor 30 relative to other components on the body 12 to provide a more balanced weight in hand as well as providing more consistent fluid flow rate compared to a gravity fed system.

The fluid distributor 30 can include at least one distributor outlet 68 for delivering fluid to the surface to be cleaned. The outlet 68 can be positioned to deliver fluid directly to the surface to be cleaned, outwardly in front of the suction nozzle 16 so that the user can clearly see where fluid is being applied. See, for example, line CF in FIG. 3 representing one possible spray path for the distributor 30. In another embodiment, the outlet 68 can deliver fluid onto the brush 38. In yet another embodiment, the outlet 68 can deliver fluid behind the suction nozzle 16 and brush 38.

The distributor 30 can comprise any structure, such as a nozzle or spray tip. Multiple distributors 30 can also be provided in other embodiments of the extraction cleaner 10. As illustrated in the figures, the distributor 30 can comprise one spray tip provided on the front of the body 12 that distributes cleaning fluid to the surface to be cleaned in front of the suction nozzle 16.

Figure 5:
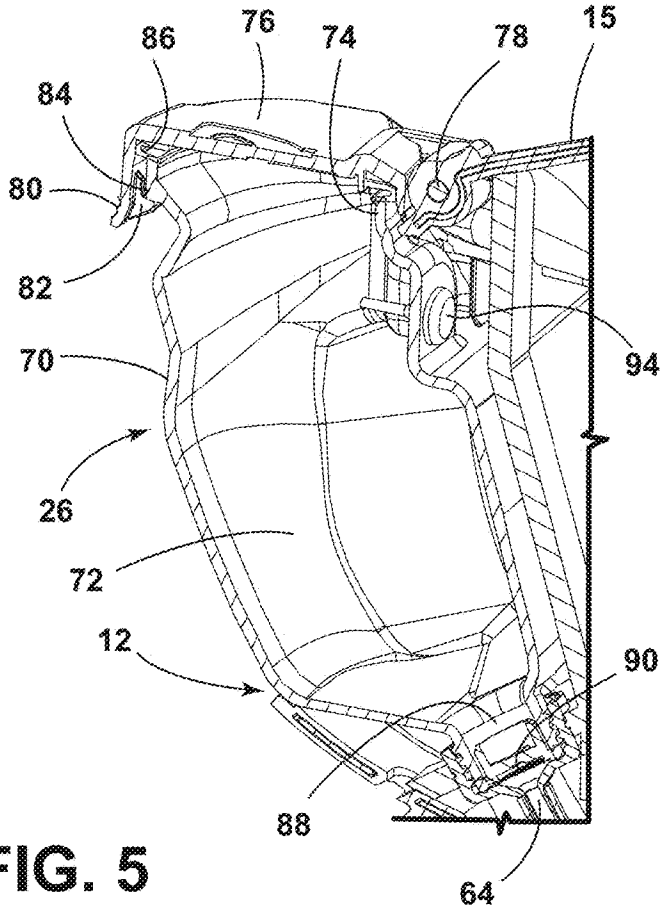
FIG. 5 is a close-up sectional view of a rear portion of the handheld extraction cleaner, taken through line II-II of FIG. 1, showing the supply tank.

FIG. 5 is a close-up sectional view showing the supply tank 26. The supply tank 26 shown is a non-removable blow-molded part, and includes a hollow tank body 70 defining a supply chamber 72 for holding a supply of cleaning liquid. In being non-removable, the supply tank 26 is not intended to be removed from the body 12, and is refillable in place on the body 12. This can eliminate potential leakage points, since that tank 26 does not need to be repeatedly coupled and uncoupled to the fluid pathway of the extraction cleaner 10.

The tank body 70 can include a fill opening 74 through which cleaning liquid can be poured into the supply chamber 72. The fill opening 74 can be provided at the rearward end of the body 12, rearward of the handle 14, and is accessible to a user when the housing 15 is resting on a surface. A fill cap 76 selectively closes the fill opening 74.

The fill cap 76 can be pivotally coupled to the housing 15 of the cleaner body 12 by a hinge 78 or other rotating connection, and can be opened to expose the fill opening 74. The pivotable coupling ensures the fill cap 76 will not completely separate from the cleaner body 12 during filling. In another aspect, the fill cap 76 can be pivotally coupled with the tank body 70.

Figure 7:
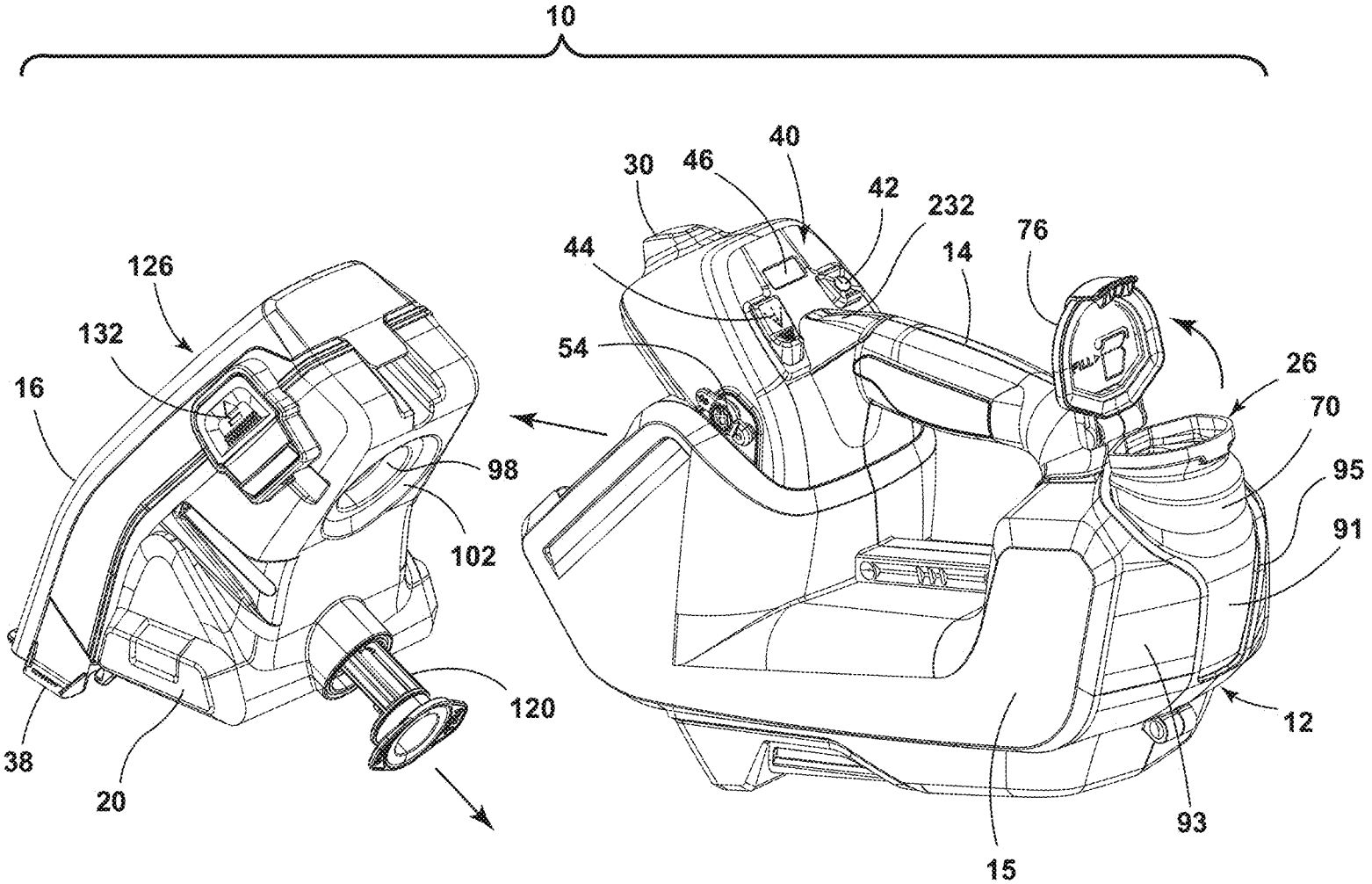
FIG. 7 is a rear perspective, partially-exploded view of the handheld extraction cleaner, showing removal of a tank assembly from a tank receiver, movement of a recovery tank drain plug to an open position, and movement of a supply tank fill cap to an open position.

The fill cap 76 can fit over the fill opening 74 when closed to seal the fill opening 74 for a fluid-tight closure, such that the supply tank 26 does not leak when the fill cap 76 is closed. One example of a closed position of the fill cap 76 is shown in FIG. 5. One example of an open or fill position of the fill cap 76 is shown in FIG. 7.

In one configuration, the fill cap 76 can be a snap-on cap providing a fluid-tight engagement with the fill opening 74 when snapped onto the tank body 70. The cap 76 can include a depending lip 80 with a snap 82 that extends from an inward side of the lip 80, and the tank body 70 can include an outwardly extending bead 84, with the snap 82 fitting tightly onto the bead 84 when cap 76 is closed. A seal 86 can be provided on an inner side of the cap 76 that confronts the fill opening 74 when the cap 76 is closed to further provide a leak-proof engagement between the fill opening 74 and the fill cap 76.

The fill cap 76 can be opened by lifting the lip 80 of the fill cap 76, which can be spaced from the tank body 70 in the closed position so that a user can fit a finger between the tank body 70 and an underside of the lip 80. When the fill cap 76 is open, liquid from a liquid source, such as a container, bottle, faucet, hose, vessel, etc. can be poured into the tank body 70 through the fill opening 74.

The tank body 70 can include a tank outlet 88 in fluid communication with the first conduit 64. A mesh screen insert 90 can be provided between the tank outlet 88 and the conduit 64 to prevent particulates of a certain size from entering the pump 32.

A first check valve 92 (FIG. 4) is provided on the tank body 70 to allow ambient air into the supply tank 26 to displace dispensed liquid. The check valve 92 can be, for example, an umbrella valve sealing at least one vent hole formed in the tank body 70. As liquid is pumped out of the supply tank 26, negative pressure inside the supply tank 26 opens the check valve 92, drawing ambient air into the supply chamber 72 to equalize pressure. Once pressure equalizes, the check valve 92 closes.

A second check valve 94 is provided on the tank body 70 for relieving positive pressure or off-gassing caused by some cleaning liquids. With some formulations of cleaning liquids, excess gas is generated inside the supply tank 26 due to reactions between various additives or off-gassing from peroxide formulations, for example. The check valve 94 can be, for example, an umbrella valve selectively sealing at least one vent hole in the tank body 70. As excess gas forms in the supply tank 26, positive pressure inside the supply tank 26 opens the check valve 94, thereby venting the excess gas into the surrounding atmosphere. Once pressure equalizes, the check valve 94 closes.

Referring to FIG. 7, the tank body 70 can define at least a portion of the rearward end 60 of the cleaner 10, and the structure of the tank body 70 is configured for added rigidity and robustness to withstand accidental drops of the extraction cleaner 10. A portion of the housing 15 can wrap around the tank body 70, while leaving a portion of the tank body 70 exposed to form an exterior surface of the extraction cleaner 10. The exposed portion can form a viewing window 91 that permits a user to ascertain the liquid fill level inside the supply tank 26. In the embodiment shown, a left rear portion 93 of the housing 15 and a right rear portion 95 of the housing 15 can wrap around corresponding sides of the tank body 70, with a space in between the housing portions 93, 95 defining the viewing window 91. Optionally, the tank body 70 can have an indicia marking (not shown) associated with the viewing window 91, which may, for example indicate a fill line for the supply tank 26. While the viewing window 91 is illustrated as being centered at the rearward end 60 of the housing 15, in some aspects, the viewing window 91 may be offset to one side of the housing or the other. In other aspects, the housing portions 93, 95 wrap entirely around the tank body 70 and the viewing window 91 is formed by a cut-out in the housing 15 adjacent the tank body 70.

In one embodiment, the supply tank 26 can be a blow-molded part made from a transparent or translucent material, with the user able to see through the tank body 70 at the exposed portion or viewing window 91 to ascertain the liquid fill level inside the supply tank 26. In another embodiment, the viewing window 91 can be formed by inserting a transparent or translucent cover into a corresponding window opening in exposed portion of the tank body 70.

Figure 6:
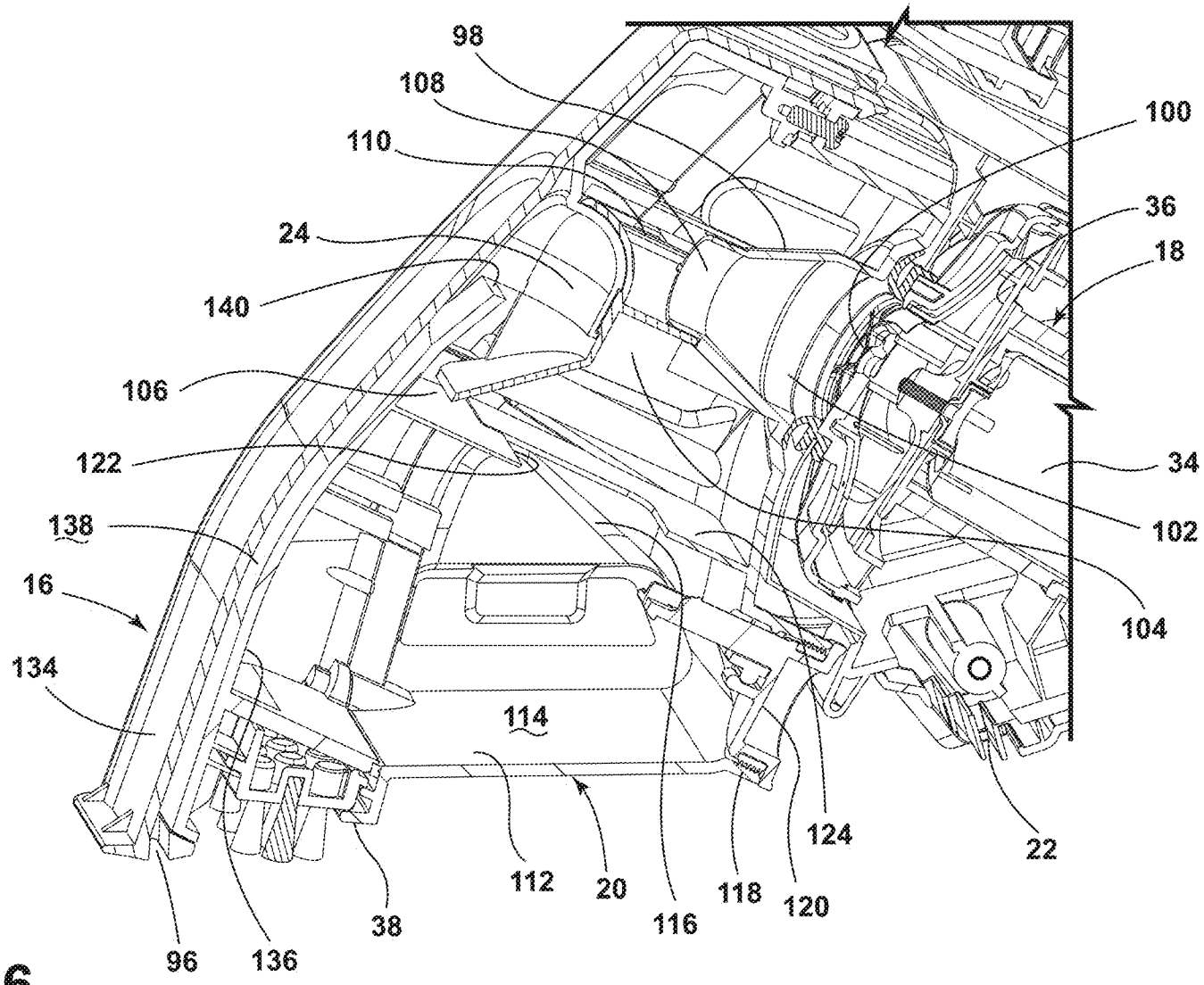
FIG. 6 is a sectional view showing a recovery system of the handheld extraction cleaner, taken through line VI-VI of FIG. 1, the recovery system including a recovery tank.

FIG. 6 is a sectional view showing the recovery system of the handheld extraction cleaner 10. As discussed above, the recovery system illustrated herein includes the suction nozzle 16, the separator 24, the recovery tank 20, the suction source 18, the exhaust vents 22 (FIG. 2), and optionally additional conduits, ducts, tubing, hoses, connectors, etc. fluidly coupling the components of the recovery system together and providing a recovery path from a nozzle inlet 96 to the exhaust vents 22.

In one configuration, working air separated from liquid and debris by the separator 24 can travel through a diffuser conduit 98 before reaching an inlet 100 of the suction source 18. The diffuser conduit 98 has a gradually-increasing cross-sectional area to decrease the speed of the working air and increase its pressure. The diffuser conduit 98 can have an outlet port 102 in fluid communication with the inlet 100 of suction source 18.

An air pathway 104 can connect an outlet 106 of the separator 24 with an inlet 108 of the diffuser conduit 98, and can be formed by various conduits, ducts, housings, connectors, etc. fluidly coupling the outlet 106 and inlet 108 together and providing an air path from the separator 24 to the diffuser conduit 98. To improve air/liquid separation and sound attenuation, the pathway 104 can be a tortuous air pathway 104, and may include baffles, guides, and other air-turning features that direct the working air and increase the length of the pathway 104. In one example, the air pathway 104 can include a baffle 110 blocking a lower portion of the conduit inlet 108 so that working air is forced to flow around and over the baffle 110 to enter the inlet 108.

The recovery tank 20 comprises a hollow tank body 112 defining a collection chamber 114 for holding a recovered liquid and debris, with a tank inlet 116 that is in fluid communication with the separator outlet 106 and a tank outlet 118 formed in the tank body 112 for emptying any liquid or debris in the recovery tank 20 that may be collected in the collection chamber 114. The tank outlet 118 can be closed by a drain plug 120 or other closure feature.

The tank inlet 116 to the recovery tank 20 can be formed as an opening 122 through a baffle wall 124 separating the collection chamber 114 from the tortuous air pathway 104, with debris and liquid that is separated from the working airstream transferrable into the recovery tank 20 through the opening 122. Other configurations for the tank inlet 116 are possible.

The baffle wall 124 can surround the opening 122 on multiple sides to block liquid from passing back through the tank inlet 116 when the extraction cleaner 10 is tipped sideways. In one configuration, the baffle wall 124 can surround the opening 122 on right and left sides, so that if the extraction cleaner 10 is tipped to the side, the baffle wall 124 keeps liquid out of the air pathway 104. Optionally, in some configurations, the baffle wall 124 can also surround the opening 122 on forward and/or rearward sides. A portion of the baffle wall 124 may extend under the separator outlet 106, and may be disposed at a downward angle when the extraction cleaner 10 is in the orientation of FIG. 3 to direct liquid back toward the tank inlet 116.

FIG. 7 is a partially-exploded view of the handheld extraction cleaner 10, illustrating the removal of the recovery tank 20 from the housing 15. The recovery tank 20 can form a modular recovery assembly 126 with the suction nozzle 16 that is removable from the housing 15 as a single unit or module, such that the recovery tank 20 and the suction nozzle 16 are removed simultaneously as a unit. At least one of the brush 38, the separator 24 (FIG. 6), the diffuser 98, or any combination thereof, may also form part of the modular recovery assembly 126. In other embodiments of the extraction cleaner 10, the recovery tank 20 can be removed by itself, e.g. without removing the suction nozzle 16, etc. At least one of the carry handle 14, supply tank 26, fluid distributor 30, or any combination thereof, may remain with the unitary body 12 when the modular recovery assembly 126 is removed, as can be seen in FIG. 7.

Figure 8:
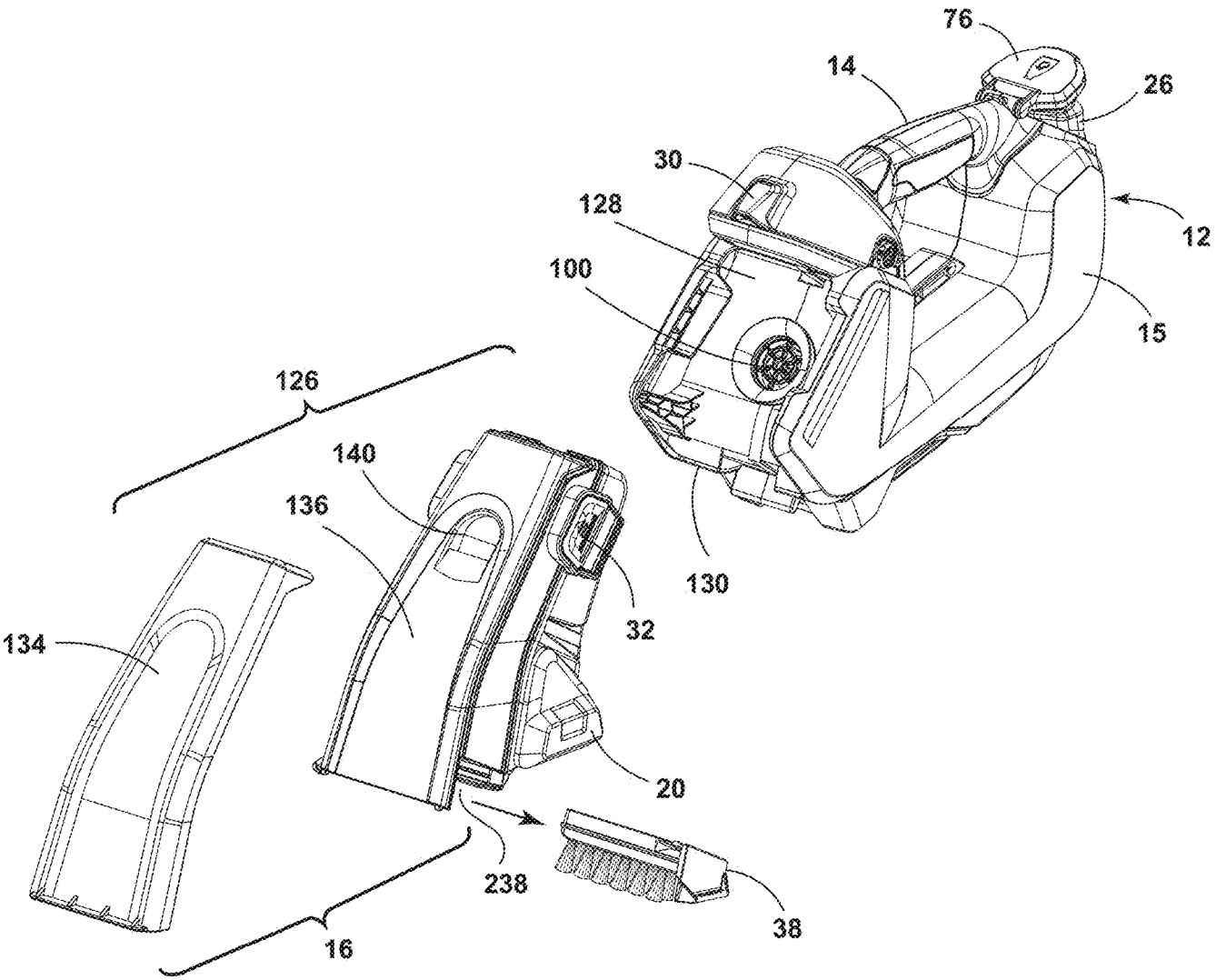
FIG. 8 is a front perspective, partially-exploded view of the handheld extraction cleaner, showing removal of a nozzle cover and an agitator from the tank assembly.

Referring to FIGS. 7-8, the modular recovery assembly 126 can be attached to a front of the housing 15 via a module receiver 128 at a forward side 130 of the housing 15. The receiver 128 includes the working air inlet 100 in fluid communication with the suction source 18 (FIG. 6). With the mounting of the recovery assembly 126 to the receiver 128, the outlet port 102 automatically mates with the inlet 100 of suction source 18. While referred to herein as a "module" receiver 128, in embodiments where the recovery tank 20 is removable by itself, the receiver 128 may be configured to mount the recovery tank 20 alone to the unitary body, and may be located elsewhere on the housing 15, such as on a bottom side of the housing 15.

Latches 132 or other suitable structures can secure the recovery assembly 126 with the receiver 128. In the embodiment shown, the latches 132 are carried by the recovery assembly 126, however it is also possible for the latches 132 to be provided on the housing 15. Other mounting arrangements for the recovery assembly 126 are possible.

In the embodiment shown, a pair of latches 132 are provided, and may be disposed on opposing lateral sides of the recovery assembly 126. Providing opposing latches 132 may allow a user to pinch the latches 132 between a thumb and at least one other finger (e.g. an index and middle finger) to de-latch and pull the recovery assembly 126 off the housing 15.

Referring to FIG. 6, the suction nozzle 16 can include a front cover 134 and a rear cover 136 defining a narrow suction pathway 138 therebetween, with an opening forming the nozzle inlet 96 at a lower end thereof. The suction pathway 138 is in fluid communication with the separator 24 leading to the recovery tank 20. The front cover 134 can optionally include a transparent or translucent window, or can be formed by a transparent or translucent material, so the user can see liquid being taken up through the suction nozzle 16 and/or determine if the suction nozzle 16 is clogged.

Referring to FIG. 8, the rear cover 136 can optionally define a portion of the recovery tank 20 and/or separator 24. An opening 140 from the suction pathway 138 to the separator 24 can be formed in the rear cover 136.

In some embodiments, the front cover 134 can be removable for cleaning clogs and the like in the suction pathway 138. For example, the front cover 134 may be removably coupled with the rear cover 136 by a snap-fit connection.

FIG. 8 shows one example of the front cover 134 removed from the rear cover 136. Alternatively, the front and rear covers 134, 136 can be fixedly attached together in a non-separable configuration.

Figure 10:
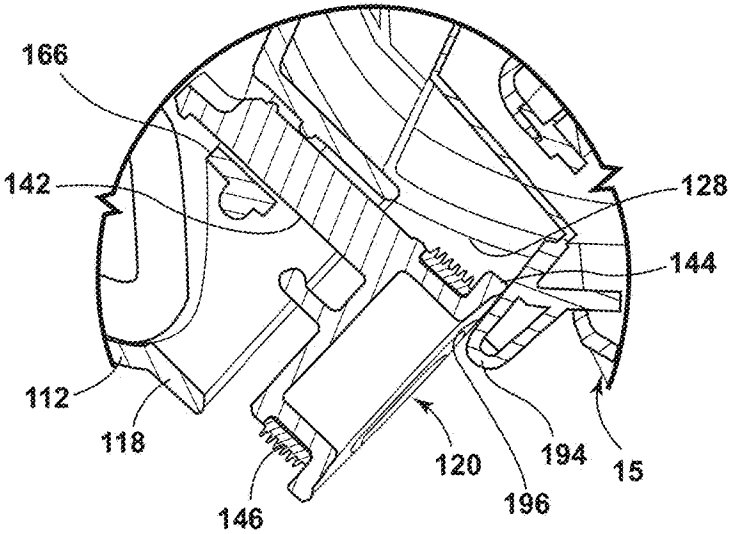
FIG. 10 is a close-up sectional view taken through line VI-VI of FIG. 1, showing the drain plug of the recovery tank in an intermediate position between the open and closed positions.
Figure 9:
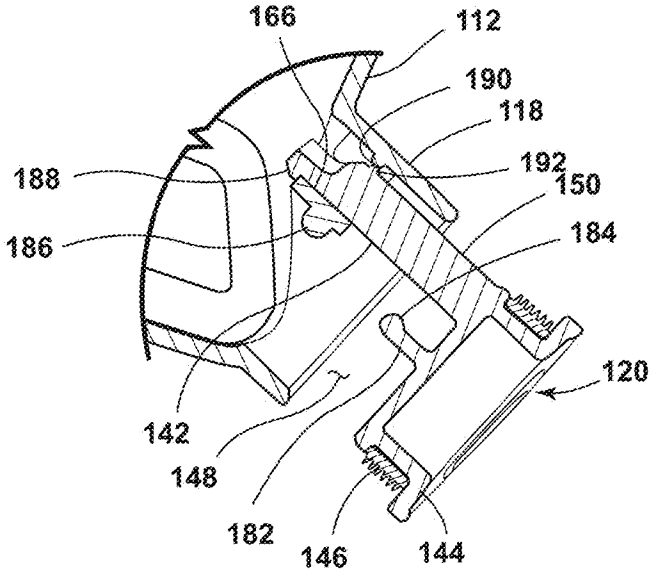
FIG. 9 is a close-up sectional view taken through line VI-VI of FIG. 1, showing the drain plug of the recovery tank in an open position.
Figure 11:
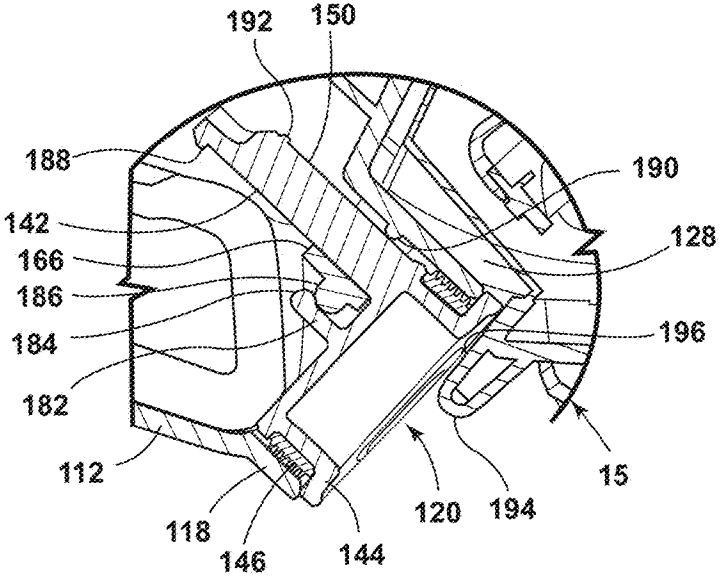
FIG. 11 is a close-up sectional view taken through line VI-VI of FIG. 1, showing the drain plug of the recovery tank in a closed position.

When the recovery assembly 126 (or recovery tank 20) is removed as shown in FIG. 7, the drain plug 120 can be opened to drain the recovery tank 20. Referring to FIGS. 9-11, the drain plug 120 is moveable between an open position (FIG. 9) in which the plug 120 is at least partially spaced from the tank outlet 118 to form a drain path to empty dirty liquid in the recovery tank 20 and a closed position (FIG. 11) in which the plug 120 seals the tank outlet 118.

The drain plug 120 can include a stem 142 and a cap 144 with a perimeter seal 146. The stem 142 can be offset on the cap 144 to define a drain passage 148 below the stem 142, e.g., oriented toward the bottom of the plug 120 when the plug 120 is open as shown in FIG. 9.

In some embodiments, the drain plug 120 slides between the open and closed positions. In the closed position the stem 142 of the drain plug 120 is pushed into the tank body 112 and the cap 144 seals the tank outlet 118. In the open position, a user can grip the cap 144 to pull the drain plug 120 out, and liquid and/or debris can drain through the drain passage 149.

Figure 13:
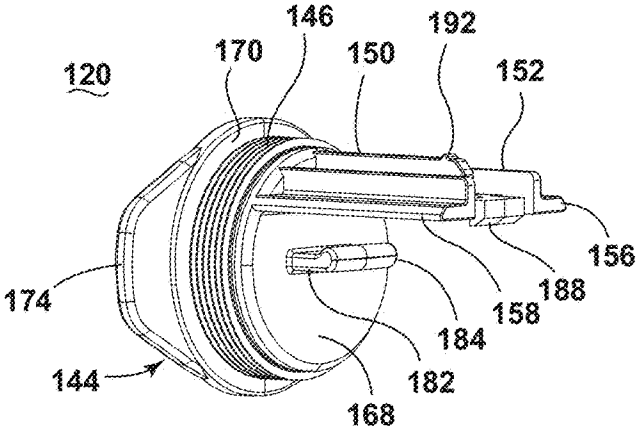
FIG. 13 is a second perspective view of the drain plug.
Figure 12:
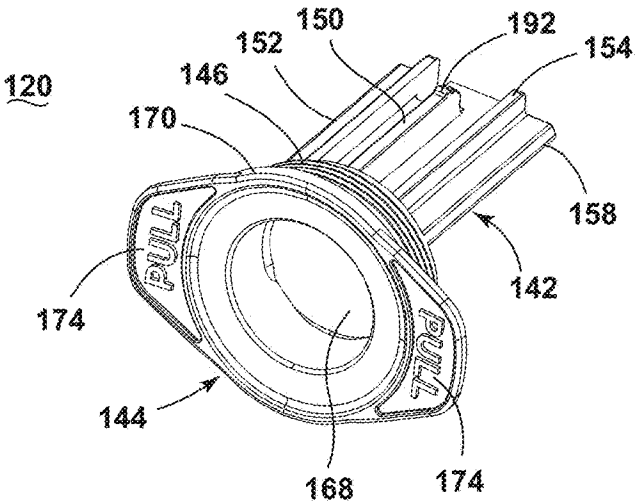
FIG. 12 is a first perspective view of the drain plug.
Figure 14:
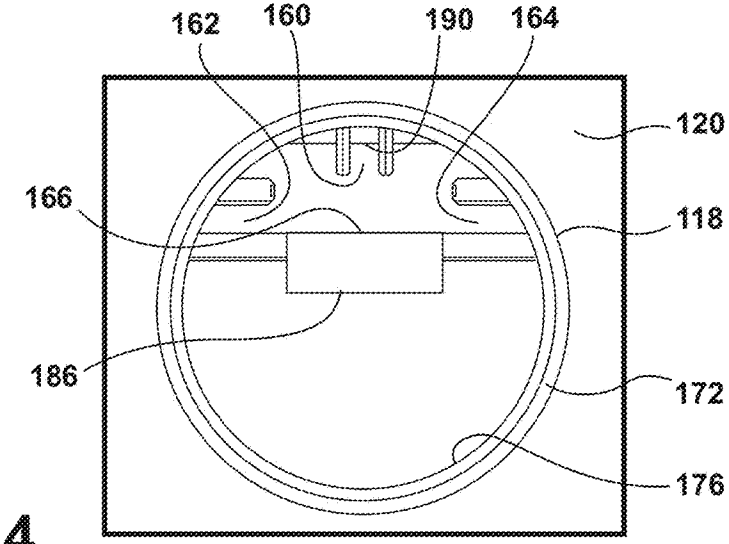
FIG. 14 is a plan view of a tank outlet of the recovery tank.

To slide the drain plug 120 between the open and closed positions, the recovery tank 20 can include a rail system. As can be seen in FIG. 12-14, the tank body 112 and stem 142 can have interacting surfaces that allow the drain plug 120 to slide smoothly into and out of the tank outlet 118. In one configuration, the stem 142 has top rails 150, 152, 154 and side rails 156, 158, and the tank body 112 has a top guide 160, side guides 162, 164, and a bottom guide 166. In addition to providing a smooth sliding motion, the rail system can orient the drain plug 120 in the tank body 112 and prevent the drain plug 120 from rotating once installed in the tank body 112.

The cap 144 has a generally flat head 168 with an outwardly extending flange 170 that is larger than the head 168. The head 168 is sized to fit within the tank outlet 118 with at least some portion of the flange 170 extending over and outwardly of a rim 172 of the tank outlet 118. When the plug 120 is closed, the flange 170 meets the rim 172 and acts as a stop for the plug 120 to limit the distance the plug 120 may be inserted into the tank outlet 118.

In certain embodiments, a portion of the flange 170 may be oversized to form pull tabs 174 on the cap 144. Providing opposing pull tabs 174 may allow a user to pinch the cap 144 between two fingers (e.g. a thumb and index finger) to pull the drain plug 120 out. Other portions of the flange 170, e.g. portions other than the pull tabs 174, may generally have an outer dimension substantially equal to an outer dimension of the tank outlet 118.

The perimeter seal 146 can comprise a gasket surrounding an outer perimeter of the head 168, and may be sized to be compressed by an interior surface 176 of the tank outlet 118 to ensure a leak-free seal when the drain plug 120 is closed.

The recovery tank 20 can have a manually releasable latching mechanism for releasably latching the drain plug 120 in the closed position. The manually releasable latching mechanism can include a snap-fit connection, with the tank body 112 and drain plug 120 having snap-fit parts which are pushed together to interlock the drain plug 120 to the tank body 112. Providing the snap-fit parts as integral attachment features on the drain plug 120 and the tank body 112 provides rapid closure and latching of the drain plug 120. Where the tank body 112 and drain plug 120 are plastic, the snap-fit parts can be integrally formed therewith.

The snap-fit connection can include a snap-lock receiver on the tank body 112 or drain plug 120, and a snap-lock element on the other, the snap-lock element being engageable with the snap-lock receiver to retain the drain plug 120 in the closed position on the tank body 112. Referring to FIGS. 9 and 11, the snap-lock element can include a cantilevered finger 182 projecting from the cap 144 of the drain plug 120, the finger 182 having a bead 184 at one end thereof. The snap-lock receiver can include a lug 186 on the bottom guide 166 or in another suitable location on the tank body 112 for engagement with the bead 184. In certain embodiments, the finger 182 is more elastic than the lug 186, and the finger 182 is elastically deformed briefly as it is pushed past the lug 186. When the drain plug 120 is pushed into the tank outlet 119, the finger 182 snaps around the lug 186, with the bead 184 seated behind the lug 186 to latch the drain plug 120 in place. The finger 182 can be spaced below the stem 142 so that the bottom guide 166 is disposed between the stem 142 and finger 182 when the drain plug 120 is closed. In order to provide feedback for the user to recognize that the drain plug 120 is latched in the closed position, movement of the bead 184 past the lug 186 can produce an audible "click" or other sound. Upon application of a sufficient force, the drain plug 120 can be pull back out of the tank outlet 118, with the finger 182 flexing to move the bead 184 under and past the lug 186. As will be evident to those skilled in the art, other manually releasable latching mechanisms may be used.

The drain plug 120 can be prevented from being pulled completely out of the tank body 112 by a stopper 188. The stopper 188 can be any feature or structure that prevents or inhibits physical separation of the drain plug 120 from the tank body 112, such as a lip, flange, rib, or other member that interferes with a corresponding feature of the tank body 112. The stopper 188 can, for example, include a lip on the bottom of the stem 142 that prevents the drain plug 120 from sliding completely out of the tank body 112 during normal use of the tank 20. As can be seen in FIG. 9, in the open position the stopper 188 can engage an edge of the bottom guide 166 to stop further sliding movement of the drain plug 120. The stopper 188 may be provided at or near a terminal end of the stem 142 to permit the drain plug 120 to extend sufficiently far to allow a large drain passage 148 to be established when the drain plug 120 is opened. As will be evident to those skilled in the art, other structures for preventing/inhibiting separation of the drain plug 120 from the tank body 112 may be used.

In some configurations, the stopper 188 can prevent the drain plug 120 from being removed from the tank body 112 by the user. In other configurations the drain plug 120 can, upon application of sufficient force, be pulled completely out of the tank body 112 by overcoming the engagement of the stopper 188 with the tank body 112. The drain plug 120 can thereafter be inserted back into the tank body 112.

The recovery tank 20 can have a manually releasable latching mechanism for releasably latching the drain plug 120 in the open position. The manually releasable latching mechanism can include a detent 190 on the tank body 112 and a boss 192 on the stem 142 of the drain plug 120. As the drain plug 120 slides into the tank body 112, the boss 192 and/or stem 142 is sufficiently elastic to allow the boss 192 to pass under the detent 190 with an applied force, while the stopper 188 prevents the plug 120 form sliding completely out of the tank body 112. The engagement between the boss 192 and detent 190 in this position prevents the plug 120 from sliding back into the tank outlet 118. In order to provide feedback for the user to recognize that the drain plug 120 is latched in the open position, movement of the boss 192 past the detent 190 can produce an audible "click" or other sound. Upon application of a sufficient force, the drain plug 120 can be pushed back into the tank outlet 118, with the boss 192 and/or stem 142 flexing to move the boss 192 under and past the detent 190 in order to move the drain plug 120 to the closed position (FIG. 11). As will be evident to those skilled in the art, other manually releasable latching mechanisms may be used.

In one configuration, the extraction cleaner 10 is provided with an auto-close feature for the recovery tank 20, wherein the plug 120 is automatically moved to the closed position by the mounting of the recovery tank 20 in the receiver 128. The auto-close feature eliminates the possibility of the recovery tank 20 being installed on the housing 15 with the drain plug 120 open by automatically closing the plug 120 when the recovery tank 20 is installed on the housing. This feature has the benefit of closing the plug 120 using the motion of assembly, e.g. the motion of the recovery tank 20 being installed on the housing 15, thereby ensuring a leak-free experience.

One embodiment of the auto-close feature is shown in FIGS. 10-11, and includes a blocker 194 on the housing 15 that pushes the plug 120 to the closed position (FIG. 11), if not already in the closed position, by the mounting of the recovery tank 20 in the receiver 128. The blocker 194 depends within or adjacent to the receiver 128 and can comprise an engagement face 196 that overlaps at least a portion of drain plug 120 when the recovery tank 20 is assembled with the receiver 128. As shown in FIG. 10, the blocker 194 can overlap a portion of the cap 144 and can press against the cap 144 as the tank 20 is seated with the receiver 128 to slide the drain plug 120 closed. FIG. 11 shows the tank 20 fully seated within the receiver 128 with drain plug 120 closed.

During mounting of the recovery tank 20, the drain area may be hidden to the user on the bottom, rear side of the tank 20, and so the position of the drain plug 120 may be overlooked. The blocker 194 thereby automatically closes the drain plug 120 if it is left open when the recovery tank 20 is installed on the housing 15. Additionally, the blocker 194 can prevent the drain plug 120 from opening while the recovery tank 20 is on the housing 15, thereby preventing unintended removal of the plug 120 without first removing the whole tank 20 or module 126 from the housing 15.

Other configurations for auto-close feature are possible depending on the configurations of the recovery tank 20, drain plug 120, and receiver 128. For example, if the drain plug 120 pivots between open and closed positions, the auto-close feature can be configured to pivot the drain plug 120 to the closed position upon mounting the recovery tank 20 to the receiver 128.

Figure 15:
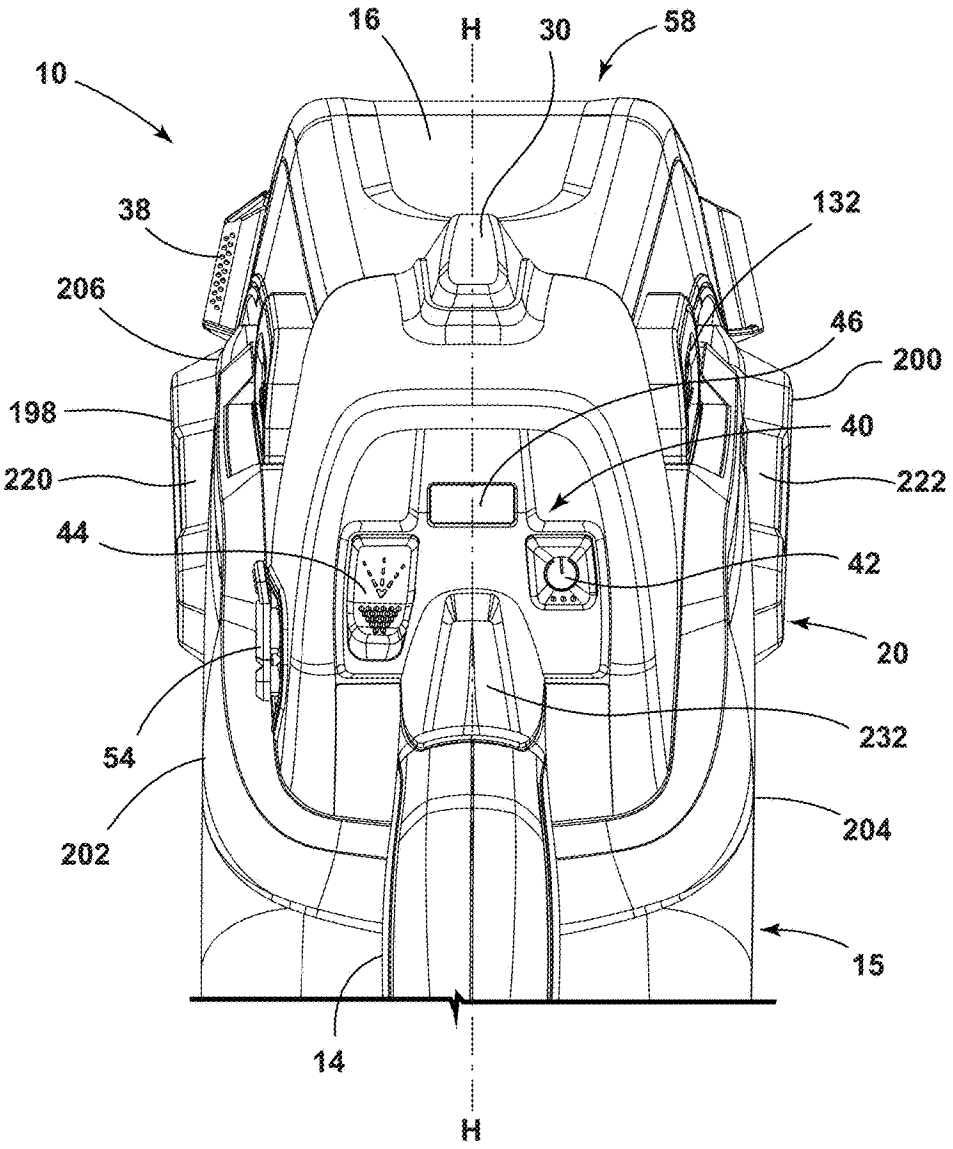
FIG. 15 is a top perspective view of the handheld extraction cleaner, generally from the perspective of a user holding the handheld extraction cleaner in an operative or normal use position, such as illustrated in FIG. 3, for example.

Referring to FIG. 15, an example of a user's perspective of the extraction cleaner 10 during operation is shown. Generally, during operation a user will grasp the extraction cleaner 10 by the carry handle 14 and engage the forward end 58 with the surface to be cleaned. The recovery tank 20 can be configured such that, in this use position, the user can view the fullness or fill level of the recovery tank 20. The recovery tank 20 can further be configured to be equally viewable by a right-handed user and a left-handed user. A right-handed user may, for example tend to hold the extraction cleaner 10 in an orientation where they see more of the left side of the extraction cleaner 10 and a left-handed user may, for example, tend to hold the extraction cleaner 10 in an orientation where they see more of the right side of the extraction cleaner 10

In one configuration, the recovery tank 20 has a tank body 112 with side portions 198, 200 that extend outwardly with respect to the housing 15 so as to be visible from the user's perspective during operation. The housing 15 has a first lateral side 202 and a second lateral side 204, which can comprise left and right lateral sides, respectively, (as viewed from the use position shown in FIG. 15) and the tank body 112 can have a first side portion 198 which is disposed laterally outwardly with respect to the first lateral side 202 of the housing 15 and a second side portion 200 which is disposed laterally outwardly with respect to the second lateral side 204 of the housing 15. In one aspect, the first and second lateral sides 202 and 204 define a lateral footprint of the forward end of the housing 15 and the first and second side portions 198 and 200 extend outwardly beyond the lateral footprint defined by the first and second lateral sides 202 and 204. In another aspect, the first and second lateral sides 202 and 204 define first and second vertical planes that intersect the first and second side portions 198 and 200, respectively.

The flared side portions 198, 200 can be disposed substantially in front of the carry handle 14. The recovery tank 20, and flared side portions 198, 200, are thus located closer to the forward end 58 of the extraction cleaner 10 than the rearward end 60 (FIG. 3) so that a user has a clear view of the tank 20 and its fill level.

The side portions 198, 200 of the tank body 112 can extend or flare outwardly relative to a longitudinal centerline of the extraction cleaner 10, which in some configurations of the extraction cleaner 10 may be defined by the handle axis H. Optionally, the side portions 198, 200 can extend in opposing directions relative to the longitudinal centerline. In the embodiment shown, the side portions 198, 200 are mirror images of each other and can be equal in volume, although it is understood that differences in shape, volume, etc. of the side portions 198, 200 is possible.

With flared side portions 198, 200 on both lateral sides 202, 204 of the housing 15, the recovery tank 20 is equally viewable by a right-handed user and a left-handed user, and a user can observe the recovery tank 20 even if the extraction cleaner 10 is tipped sideways. The flared shape of the recovery tank 20 can also increase the collection capacity of the tank body 112. The flared side portions 198, 200 allow the volume of collected liquid to spread out laterally, which can reduce the height of collected liquid.

Figure 16:
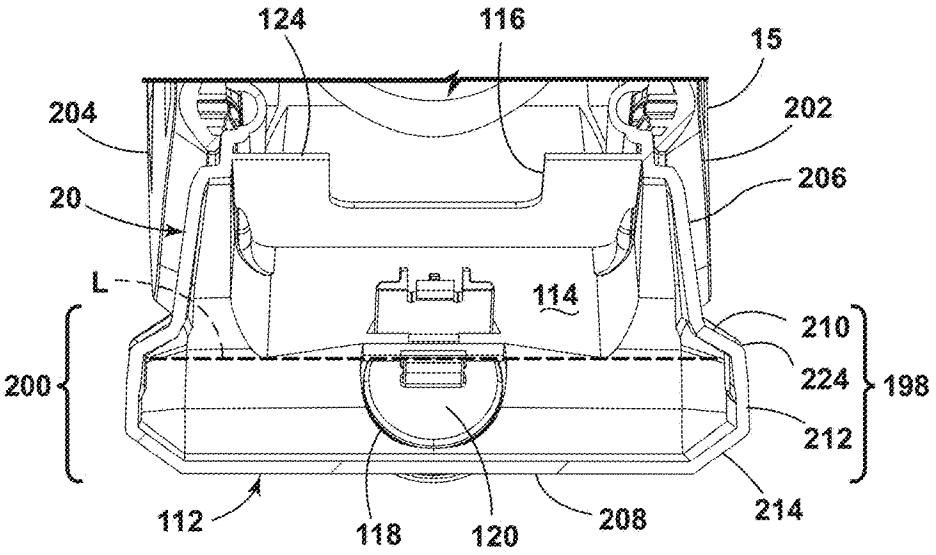
FIG. 16 is a cross-sectional view taken through line XVI-XVI of FIG. 3, showing an exemplary liquid level in the recovery tank when the extraction cleaner is operating on a horizontal surface.
Figure 17:
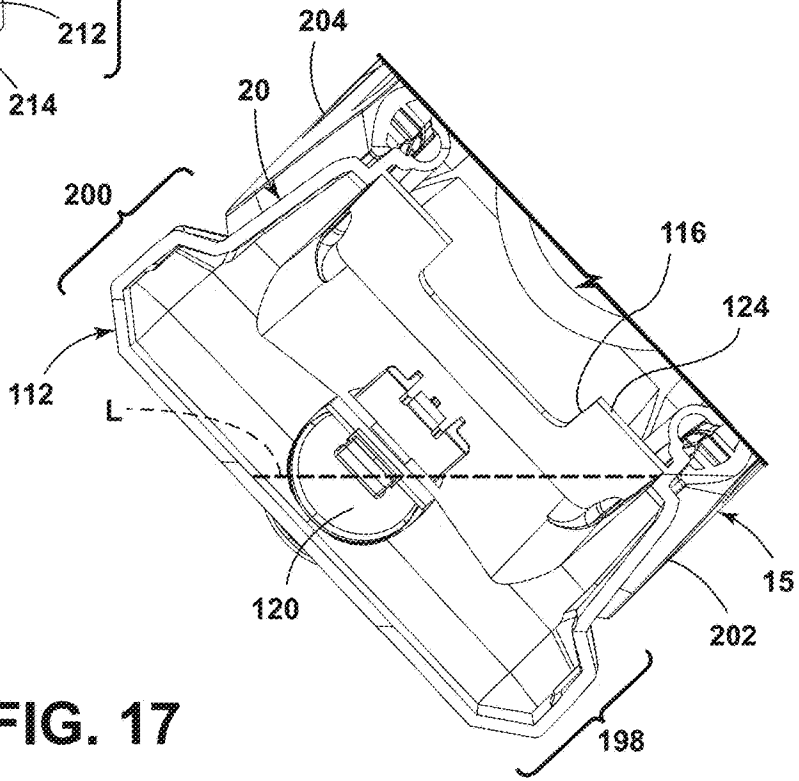
FIG. 17 is a view similar to FIG. 16 showing the liquid level in the recovery tank when the extraction cleaner is tipped to one side.

Another benefit to having flared side portions 198, 200 on both sides of the recovery tank 20 is an increase in volume available on each side of the tank 20 when the extraction cleaner 10 is tipped sideways. FIGS. 16-17 are cross-sectional views taken through line XVI-XVI of FIG. 3 showing a liquid level indicated by phantom line L for a given volume of liquid in the tank 20 when the extraction cleaner 10 is in two different exemplary orientations. FIG. 16 shows the liquid level L when the extraction cleaner 10 is in the orientation of FIG. 3 and operating on a horizontal surface S to be cleaned. FIG. 17 shows the liquid level L for the same volume of liquid when the extraction cleaner 10 is tipped to the left. In the tipped position, a greater portion of the liquid moves into the space defined by the first side portion 198. When the extraction cleaner 10 is tipped to the right, a greater portion of the liquid can move into the space defined by the second side portion 200. When tipped, the liquid level L does not rise up to the height of the tank inlet 116, but rather spreads into the corresponding side portion 198, 200. Therefore, there is less likelihood of ingestion of liquid into the air pathway 104.

To help prevent the liquid from reaching the air pathway 104, the baffle wall 124 in the tank 20 can block the liquid when the extraction cleaner 10 is tipped sideways. Below a certain level of liquid and at certain degrees of tip, liquid in the tank 20 cannot reach the tank inlet 116. With the provision of the flared side portions 198, 200 and/or the baffle wall 124, the recovery tank 20 does not require an in-tank float-style shut off. In other words, the recovery tank 20 is a float-less tank.

Figure 18:
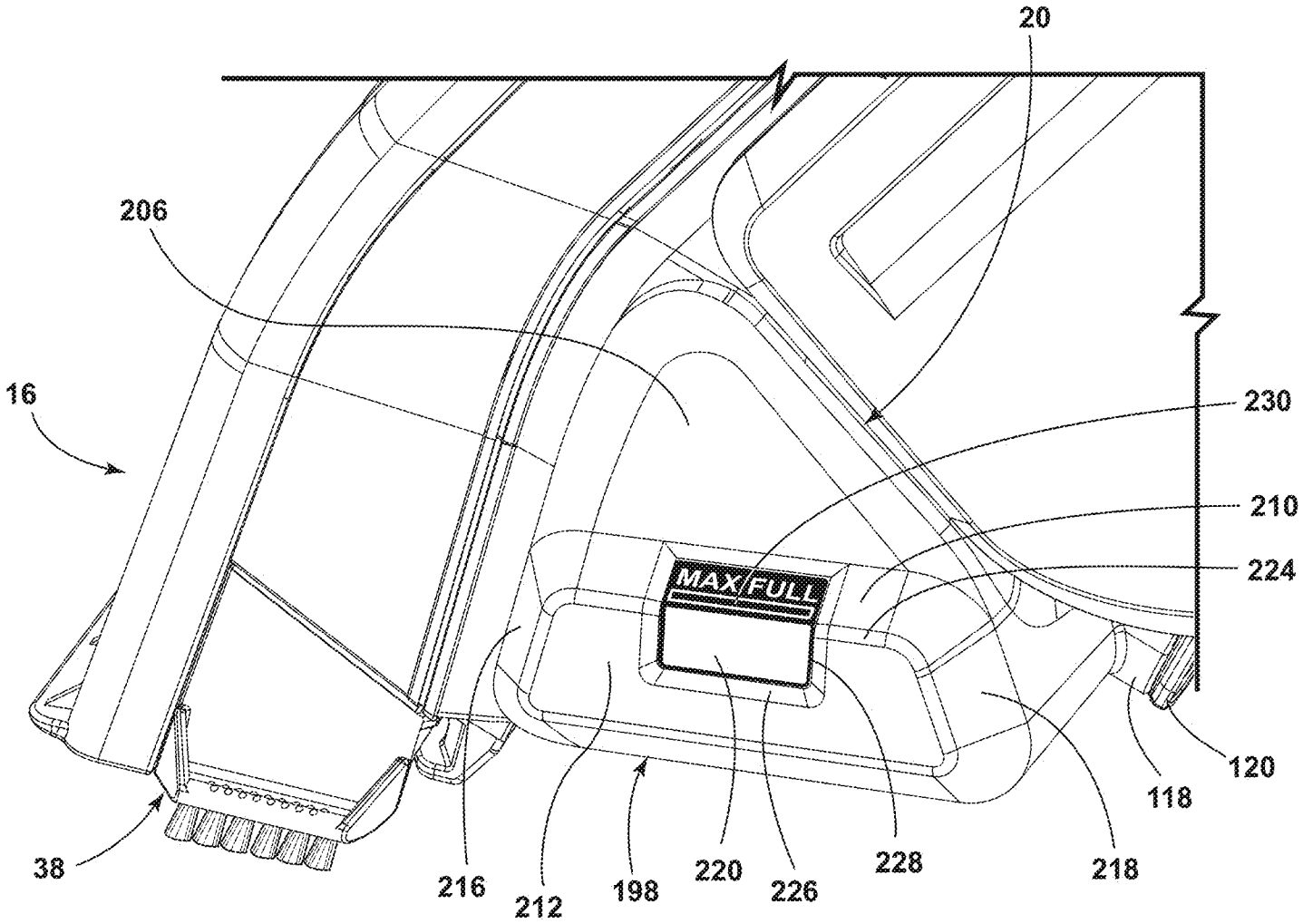
FIG. 18 is a side perspective view of the handheld extraction cleaner, showing a flared side portion and viewing window of the recovery tank.

Various shapes for the flared side portions 198, 200 are possible. Referring to FIGS. 16-18, one embodiment of the first side portion 198 is disclosed. It is understood that the second side portion 200 may have the same or a similar configuration.

The tank body 112 can have a tank side wall 206 and the first side portion 198 can extend outwardly from the tank side wall 206. The tank side wall 206 can be flush with or recessed to the first lateral side 202 of the housing 15, such that the tank side wall 206 is disposed substantially in line with or laterally inwardly of the first lateral side 202. At a bottom end thereof, the flared side portion 198 can turn back in toward the housing 15, and can meet a bottom wall 208 of the tank body 112.

Referring to FIG. 16, the first side portion 198 can include at least an upper wall 210, an outer wall 212, and a lower wall 214. One or more of these walls can be angled so that the first side portion 198 has a contour that can encourage liquid to move toward the tank outlet 118, which is closed by the drain plug 120 in FIG. 16. For example, the upper and lower walls 210, 214 can taper toward the outer wall 212 so that the first side portion 198 has a double beveled contour when viewed from the front or from the rear. With a contour that tapers downwardly and toward the center of the tank 20, liquid is encouraged to move downwardly along the walls 210-214 and toward the tank outlet 118. Referring to FIG. 18, the first side portion 198 can include a front wall 216 at a forward end of the outer wall 212 and a rear wall 218 at a rearward end of the outer wall 212. These walls 216, 218 can also be angled to encourage liquid to move downwardly along the walls 216, 218.

The bottom wall 208 can also have a shape which improves cleaning liquid drainage and usable tank volume, such as by sloping rearwardly toward the tank outlet 118 when the extraction cleaner 10 is at rest on the resting surface 62 (FIG. 3), which directs dirty liquid away from the tank inlet 116 and toward the tank outlet 118. Similarly, when the recovery assembly 126 is removed and rested on a surface, the recovery assembly 126 is supportable on a bottom edge of the plug 120 and the brush 38, and the bottom wall 208 is oriented to slope rearwardly toward the tank outlet 118.

A level viewing window 220, 222 can be located on one or both side portions 198, 200 of the recovery tank 20 with the viewing windows 220, 222 providing information to the user on the fill level within the recovery tank. With viewing windows 220, 222 on both lateral sides 202, 204 of the housing 15, a user can be informed of the fill level regardless of whether the extraction cleaner 10 is held in their right or left hand, and even if the extraction cleaner 10 is tipped sideways.

The viewing windows 220, 222 can be a transparent or translucent portion of the recovery tank 20 through which the fill level in the recovery tank 20 can be visually determined. In one embodiment, the recovery tank 20 can be a blow-molded part made from a transparent or translucent material, with the viewing windows 220, 222 comprising molded features in the tank body 112. In another embodiment, the viewing windows 220, 222 can be formed by inserting a transparent or translucent cover into a corresponding window opening in the tank body 112.

Various configurations for the viewing windows 220, 222 are possible. Referring to FIG. 17, one embodiment of the first viewing window 220 is disclosed. It is understood that the second viewing window 222 may have the same or a similar configuration.

In the exemplary embodiment in FIG. 18, viewing window 220 is located on two walls 210, 212 of the tank body 112, and wraps around a corner 224 between the two walls 210, 210. Locating the viewing window 220 on the upper wall 210 and outer side wall 212 of the side portion 198 places the viewing window 220 in the user's line of sight, with a user being able to see the viewing window 220 from a centered perspective shown in FIG. 15 or when the extraction cleaner 10 is tilted sideways for cleaning an angled surface. FIG. 18 shows an example of a user's perspective of the extraction cleaner 10 during operation, where the user has tilted the extraction cleaner 10 sideways.

The viewing window 220 can be recessed into the walls 210, 212. In an embodiment where the viewing window 220 is a molded feature in the tank body 112, a beveled edge 226 can serve as a transition between the walls 210, 212 and the recessed window 220.

Optionally, the tank body 112 can have indicia markings associated with the viewing window 220. One exemplary embodiment of such indicia markings is shown in FIG. 18, where the viewing window 220 has a border marking 228 in a contrasting color to the tank body 112 that draws a user's attention to the viewing window 220. Observing a fill level within the border marking 228 can signal to the user that a fill quantity in the recovery tank 20 is approaching a maximum level and/or is within a recommended range for emptying the tank 20. The viewing window 220 can also have a maximum fill line 230 that indicates a recommended maximum fill quantity in the recovery tank 20. The border marking 228 can wrap around the corner 224 and the maximum fill line 230 extend along the corner 224, and preferably above the corner 224. It is understood that the second viewing window 222 may have the same or similar indicia markings.

Referring to FIG. 15, in addition to the recovery tank 20, the suction nozzle 16, distributor 30, user interface 40, brush 38, or any combination thereof, may be in the line of sight of the user during normal operation of the extraction cleaner 10. In the exemplary embodiment, the user interface 40 is not symmetrical about the handle axis H, but is convenient for use by a right-handed or left-handed user. Gripping the carry handle 14 in one hand, whether left or right, allows both input controls 42, 44 to be actuated by the thumb of that same hand. The end of the carry handle 14 toward the user interface 40 can have a recessed thumb rest 232 for the user's thumb, so that the thumb of the hand gripping the carry handle 14 has a "home" or resting space, and does not accidentally bump the input controls 42, 44. The input controls 42, 44 can be different in size, shape, color, tactile elements, and the like, so that a user can distinguish between them by sight or by feel.

In one embodiment, the carry handle 14 is elongated along the handle axis H, and has a first lateral handle side on a first side of handle axis H and a second lateral handle side on a second side of the handle axis H. The input controls 42, 44 can be on opposing sides of the handle axis H. For example, the first input control 42 can be spaced from the handle axis H on the first side thereof and the second input control 44 can be spaced from the handle axis H on the second side thereof. In the illustrated configuration, the first input control 42 is spaced from the first lateral handle side of the carry handle 14 and the second input control 44 is spaced from the second lateral handle side of the carry handle 14.

Figure 19:
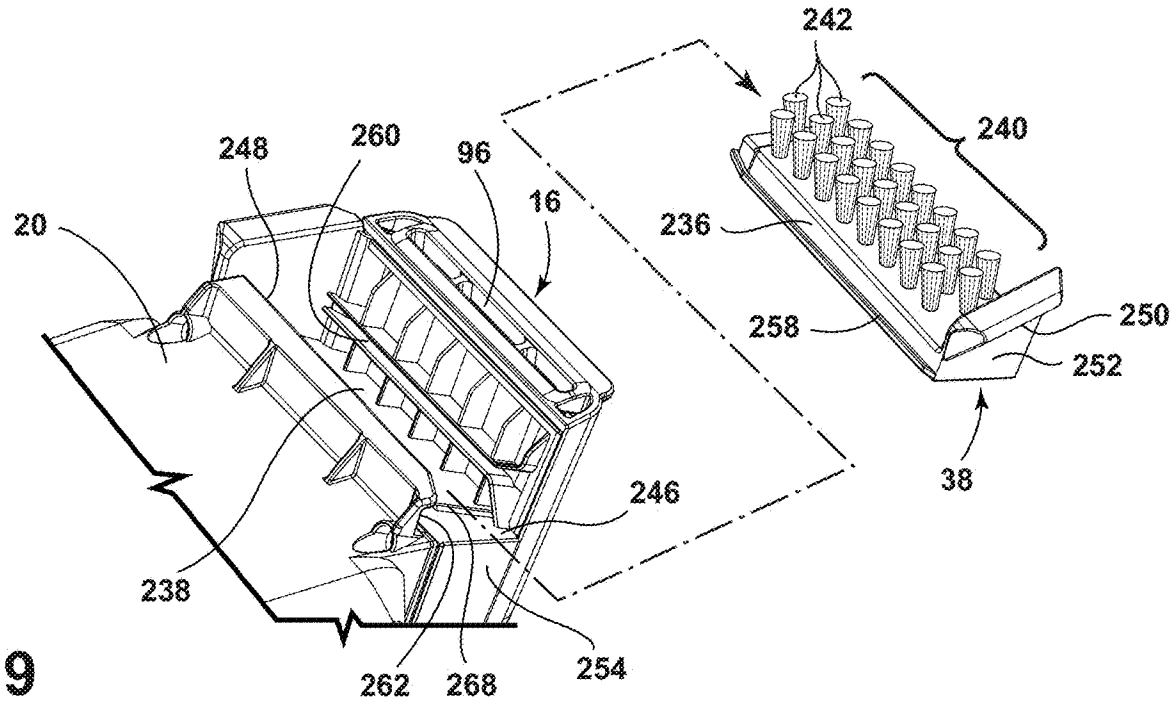
FIG. 19 is a bottom perspective view of the handheld extraction cleaner, showing the removal of the agitator.
Figure 21:
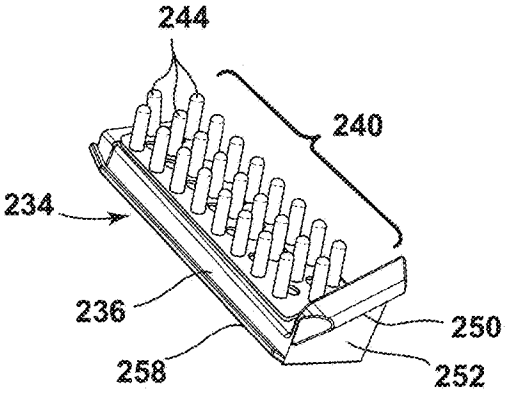
FIG. 21 is a perspective view of an alternative agitator for the handheld extraction cleaner.
Figure 20:
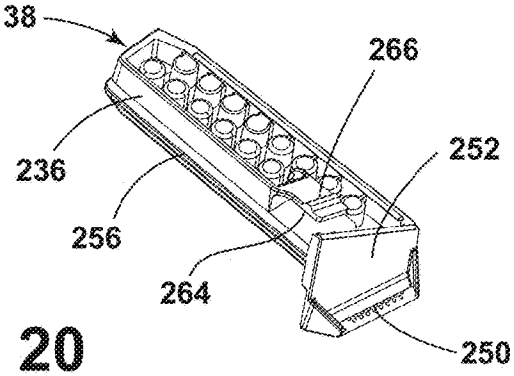
FIG. 20 is a perspective view of the agitator from FIG. 19.

Referring to FIGS. 19 and 20, in some embodiments of the extraction cleaner 10, the brush 38 is removably mounted on the body 12 for cleaning and/or replacement of the brush 38. Optionally, the brush 38 can be exchanged for another agitator. In some embodiments, multiple agitators can be provided with the handheld extraction cleaner 10 and can be interchangeably mounted to the body 12. One example of another brush 234 is shown in FIG. 21. It is noted that although FIG. 19 shows the extraction cleaner 10 upside down, one of the advantages of this design is that extraction cleaner 10 does not have to be tipped over to remove the brush 38. The brush 38 can be removed, for example, when the extraction cleaner 10 is in a normal operative position.

Each of the brushes 38, 234 can have a brush mount 236 configured to fit within a brush receiver 238 and an agitation element 240 supported by the brush mount 236. Alternatively, one brush mount 236 can be interchanged among different agitation elements. The brush mount 236 can be constructed of a polymeric material such as acrylonitrile butadiene styrene (ABS), polypropylene or styrene, or any other suitable material such as plastic, wood, or metal.

In the embodiment of the brush 38 shown in FIGS. 19-20, the agitation element 240 is a plurality of bristles 242. The pattern, shape and type of bristles 242 can vary from the pattern, shape, and type shown herein. The bristles 242 can be constructed of nylon, or any other suitable synthetic or natural fiber. The bristles 242 may be arranged in a plurality of tufts or in a unitary strip. The bristle tufts can be arranged in a single or multiple rows, optionally with the tufts staggered between rows to maximize the density of bristles on the brush mount 236.

In the embodiment of the brush 234 shown in FIG. 21, the agitation element 240 is a plurality of tines 244. The tines 244 can be pliant, i.e. flexible or resilient, in order to bend readily by contact with the surface to be cleaned, yet remain undeformed by normal use of the apparatus 10. Optionally, the tines 244 can be formed of an elastomer, such as ethylene propylene diene monomer (EPDM) rubber, thermoplastic elastomer (TPE), or thermoplastic polyurethane (TPU). The tines 244 can be arranged in a single or multiple rows, optionally with the tines 244 staggered between rows to maximize the density of tines 244 on the brush mount 236. Other types of agitation elements 240 are possible, such as paddles, flails, wires, elongated teeth or short nubs, microfiber material, or a scrubbing material, such as a non-woven or open cell foam scrubbing material.

The brush receiver 238 can comprise any structure suitable to mount the brush 38. For example, in the exemplary embodiment, the receiver 238 comprises a substantially closed pocket on the extraction cleaner 10, with a side-facing opening 246 through which the brush 38 can be installed and removed, and a downward-facing opening 248 through which the agitation elements 240 can project to engage a surface to be cleaned.

For removal of the brush 38 as a unit with the suction nozzle 16 and the recovery tank 20, the brush receiver 238 is preferably part of the modular recovery assembly 126. As shown herein, in one embodiment the brush receiver 238 can be defined by portions of the suction nozzle 16 and recovery tank 20, with the brush 38 thereby generally disposed behind the suction nozzle 16 and forward of the tank 20. Other locations for the brush receiver 238 are possible.

To facilitate insertion and removal of the brush 38, a handle 250 can be provided at the end of brush 38. The handle 250 can be coupled with, such as by being integrally formed with or otherwise joined to, the brush mount 236. The handle 250 provides a convenient place to grip the brush 38 during insertion or removal. When installed on the extraction cleaner 10, an end surface 252 of the brush mount 235 bearing the handle 250 can form an exterior surface of extraction cleaner 10, and can be substantially continuous with an exterior side surface 254 of the suction nozzle 16.

In some embodiments, the brush 38 slides into and out of the brush receiver 238. The brush mount 236 and brush receiver 238 can have interacting surfaces that allow the brush 38 to slide smoothly into and out of the receiver 238. In one configuration, the brush mount 236 can include rails 256, 258 and the receiver 238 has rail guides 260, 262 that receive the rails 256, 258.

The brush 38 can be removable through the exterior side surface 254 of the suction nozzle 16, and the rails 256, 258 and guides 260, 262 can extend generally parallel to the nozzle inlet 96. This arrangement of component parts of the extraction cleaner 10 allows the user to remove the brush 38 without needing to tip the cleaner 10 over and/or without the use of tools, and/or can offer a compact unit with the brush 38 disposed closely to the nozzle inlet 96.

The extraction cleaner 10 can have a manually releasable latching mechanism for releasably latching the brush 38 within the receiver 238. The manually releasable latching mechanism can include a snap-fit connection, with the brush mount 236 and brush receiver 238 having snap-fit parts which are pushed together to interlock the brush 38 to the brush receiver 238. Providing the snap-fit parts as integral attachment features on the brush mount 236 and receiver 238 provides rapid mounting and latching of the brush 38. Where the brush mount 236 and receiver 238 are plastic, the snap-fit parts can be integrally formed therewith.

Figure 22:
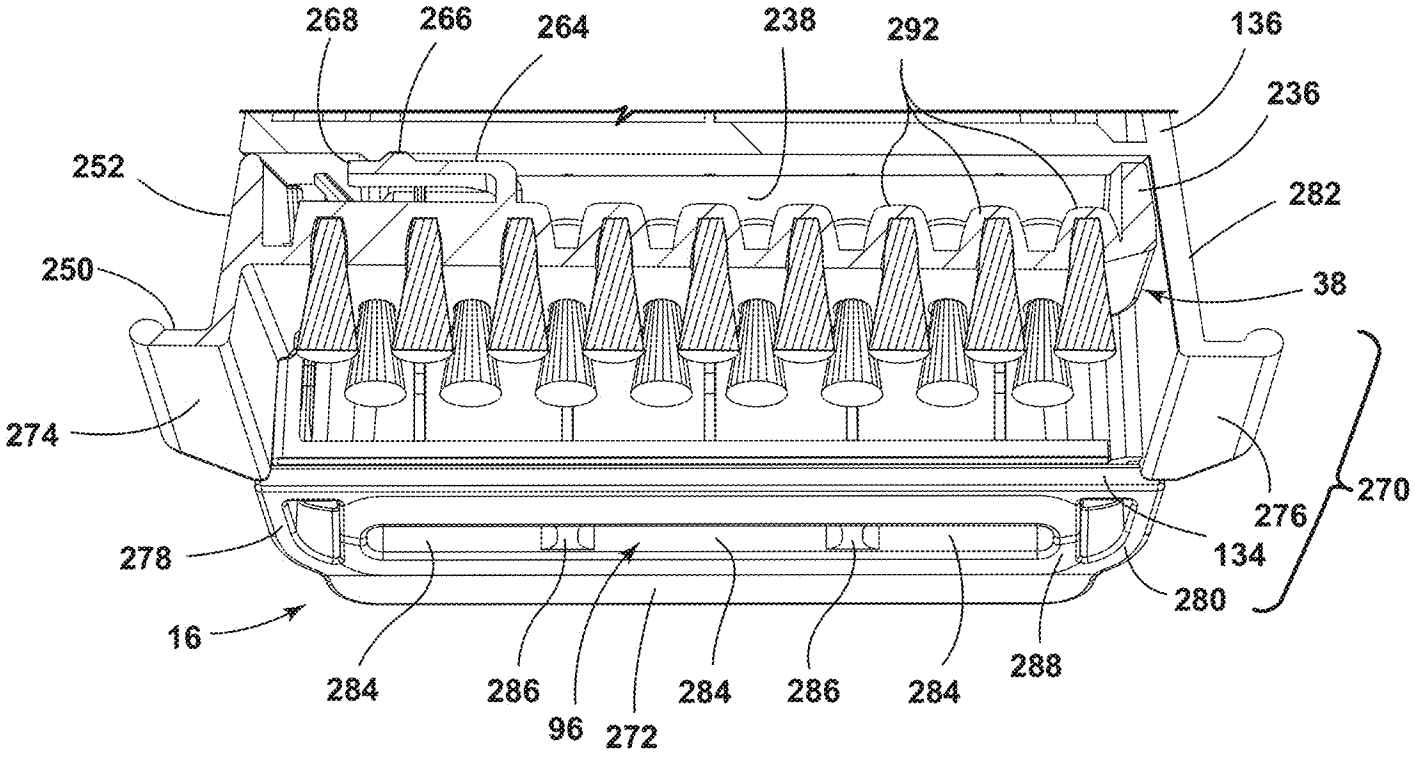
FIG. 22 is a cross-sectional view taken through line XXII-XXII of FIG. 1, showing the agitator latched within an agitator receiver of the extraction cleaner and a guide skid of the extraction cleaner.
Figure 23:
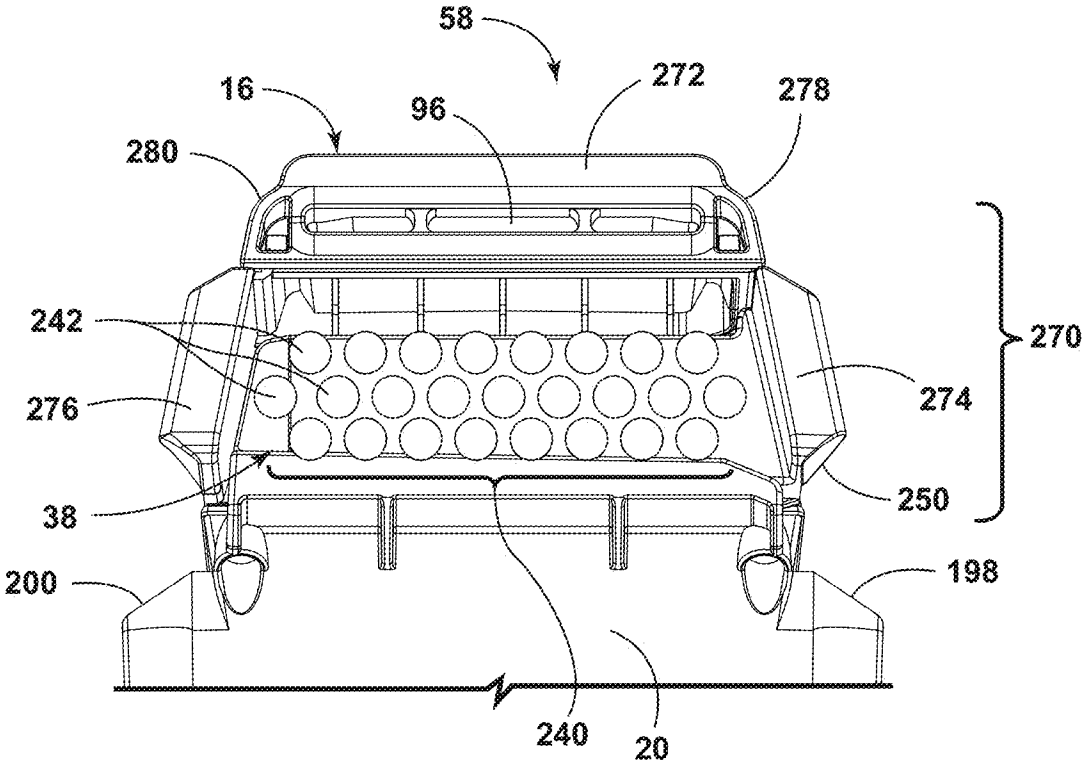
FIG. 23 is a bottom view of a forward portion of the extraction cleaner.

FIG. 22 is a cross-sectional view showing the brush 38 latched within the receiver 238. The snap-fit connection can include a snap-lock receiver on the brush mount 236 or brush receiver 238, and a snap-lock element on the other, the snap-lock element being engageable with the snap-lock receiver to retain the brush 38 in the receiver 238. The snap-lock element can include a cantilevered finger 264 projecting from the brush mount 236, the finger 264 having a bead 266 at one end thereof. The snap-lock receiver can include a lug 268 in a suitable location on the brush receiver 238 for engagement with the bead 266. In certain embodiments, the finger 264 is more elastic that the lug 268, and the finger 264 is elastically deformed briefly as it is pushed past the lug 268. When the brush 38 is pushed into the receiver 238, the finger 264 snaps around the lug 268, with the bead 266 seated behind the lug 268 to latch the brush 38 in place. In order to provide feedback for the user to recognize that the brush 38 is latched in place, movement of the bead 266 past the lug 268 can produce an audible "click" or other sound. Upon application of a sufficient force, the brush 38 can be pulled back out of the receiver 238 using the handle 250, with the finger 264 flexing to move the bead 266 under and past the lug 268. Alternatively, in some embodiments, the finger 264 may be carried by the received 238 and the lug 268 may be carried by the brush 38. As will be evident to those skilled in the art, other manually releasable latching mechanisms may be used.

Figure 24:
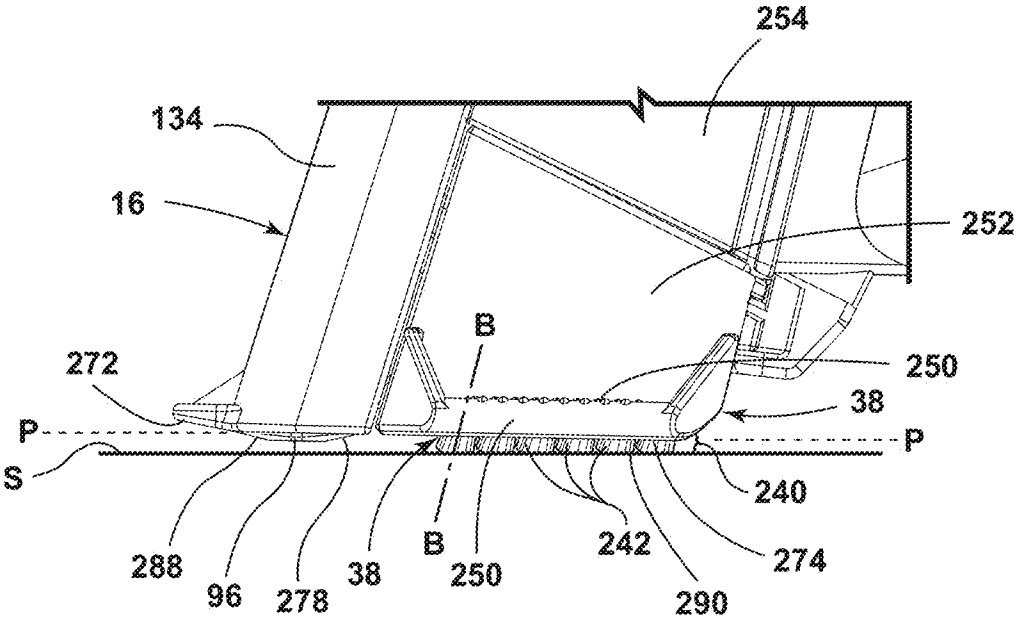
FIG. 24 is a close-up, side view of the handheld extraction cleaner in one example of a normal use position.

Referring to FIGS. 22-25, the suction nozzle 16 can have a cleaning angle guide skid 270 to orient the extraction cleaner 10 at a predetermined cleaning angle for efficient extraction with respect to a surface S to be cleaned. For example, the predetermined cleaning angle may be an angle in which the nozzle inlet 96 is sufficiently flat adjacent to and/or against the surface S for efficient extraction, when the nozzle inlet 96 is sealed with the surface S, and/or when the distance between the surface S and the nozzle inlet 96 is small. FIG. 24 shows the extraction cleaner 10 in one non-limiting example of an optimal cleaning position in which the nozzle inlet 96 is substantially flat against the surface S. The optimal cleaning position for efficient extraction may vary depending on the relative disposition of the components of the cleaner 10, such as but not limited to the body 12, carry handle 14, suction nozzle 16, and nozzle inlet 96. A user may not understand the angle for optimal extraction, and may not intuitively tip the extraction cleaner 10 far enough forward. The cleaning angle guide skid 270 provides a structural element that encourages the user to naturally orient the cleaner 10 at an optimal angle for efficient extraction. As an added benefit, the cleaning angle guide skid 270 can help the extraction cleaner 10 glide over the surface S, which helps the user the move the extraction cleaner 10 smoothly over the surface.

The guide skid 270 can include one or more skis, lips, runners, gliding surfaces, skids, or the like surrounding the nozzle inlet 96 and/or the brush 38, and which may at least partially support the forward end 58 of the extraction cleaner 10 on the surface to be cleaned. In one embodiment, the guide skid 270 can include at least a front ski 272 and side skis 274, 276 behind the front ski 272. The skis 272-276 can have substantially flat contact surfaces, or may be slightly tapered or curved to help the suction nozzle 16 glide over the surface for easy movement of the cleaner 10 in a back and forth direction across the surface to be cleaned. Thus, the skis 272-276 of the guide skid 270 allow the suction nozzle 16 to glide over the surface S in a similar manner as a ski so that a user can pass or glide the extraction cleaner smoothly over a surface. While various configurations for the skis 272-276 are possible, the skis 272-276 can preferably have smoothly curved or angled surfaces, edges, corners, and the like, to reduce sliding friction.

In certain embodiments, the side skis 274, 276 can project in a direction transverse to that of the front ski 272. With multiple skis 272-276 projecting in multiple directions around the periphery of the suction nozzle inlet 96, the user is guided to position the cleaner 10 at an optimal angle for efficient extraction, particularly one in which the suction nozzle inlet 96 is flat or nearly flat against the surface to be cleaned.

The front ski 272 can comprise an elongated, slender runner that extends substantially the width of the nozzle inlet 96 across the front of the suction nozzle 16. In the embodiment shown, the front ski 272 can project from a forward edge of the front nozzle cover 134. Where the nozzle cover 134 and front ski 272 are plastic, the front ski 272 can be integrally formed with the nozzle cover 134.

In certain embodiments, the guide skid 270 can further include intermediate skis 278, 280 that extend alongside the lateral ends of the nozzle inlet 96 and which can substantially bridge a gap between the front ski 272 and side skis 274, 276. In the embodiment shown, the intermediate skis 278, 280 can be defined by bottom surfaces of the front nozzle cover 134. Where the nozzle cover 134 and intermediate skis 278, 280 are plastic, the intermediate skis 278, 280 can be integrally formed with the nozzle cover 134.

The side skis 274, 276 can comprise elongated, slender runners that extend rearwardly of the nozzle inlet 96 and are disposed on either side of the agitation element 240 of the brush 38. This extends the guiding action of the cleaning angle guide skid 270 to the brush 38 as well as the nozzle inlet 96, thereby ensuring that both the brush 38 and the suction nozzle 16 are positioned at an optical cleaning position.

The first side ski 274 is generally on the first lateral side 202 of the housing 15, and can project laterally outwardly of the exterior side surface 254 of the suction nozzle 16. The second side ski 276 is generally on the second lateral side 204 of the housing 15, and can project from an exterior side surface 282 of the suction nozzle 16 that is diametrically opposed to the exterior side surface 254.

The first side ski 274 can be defined by a bottom surface of the brush handle 250. The handle 250 thereby forms a portion of the guide skid 270, making a separate ski surface on that side of the extraction cleaner 10 unnecessary, as the brush 38 itself can carry the ski 274. This offsets the handle 250 of the brush 38, placing the handle 250 closer to the nozzle inlet 96 of the suction nozzle 16. Where the brush mount 236 and side ski 274 are plastic, the side ski 274 can be integrally formed with the brush mount 236.

In the embodiment shown, the second side ski 276 can project from a side of the rear nozzle cover 136. Where the nozzle cover 136 and side ski 276 are plastic, the side ski 276 can be integrally formed with the nozzle cover 136. In certain embodiments, the handle 250 and ski 276 can be generally the same in size and shape, but can be different in color, tactile elements, and the like, so that a user can distinguish where the brush 38 is disposed.

It is noted that nozzle inlet 96 can be single opening extending substantially the width of the suction nozzle 16, or a plurality of smaller openings 284 separated by dividers 286 as shown in FIG. 22, the dividers 286 serving the reinforce the suction nozzle 16. The dividers 286 can be flush with or recessed with respect to the guide skid 270.

An inclined peripheral wall 288 can extend around the nozzle inlet 96, the inclined peripheral wall 288 extending from the guide skid 270 downwardly and inwardly toward the openings 284. The peripheral wall 288 surrounding the nozzle inlet 96 may therefore project slightly with respect to the guide skid 270. In other embodiments, the wall 288 surrounding the nozzle inlet 96 may not project relative to the guide skid 270, and may for example be flush with the guide skid 270.

Figure 25:
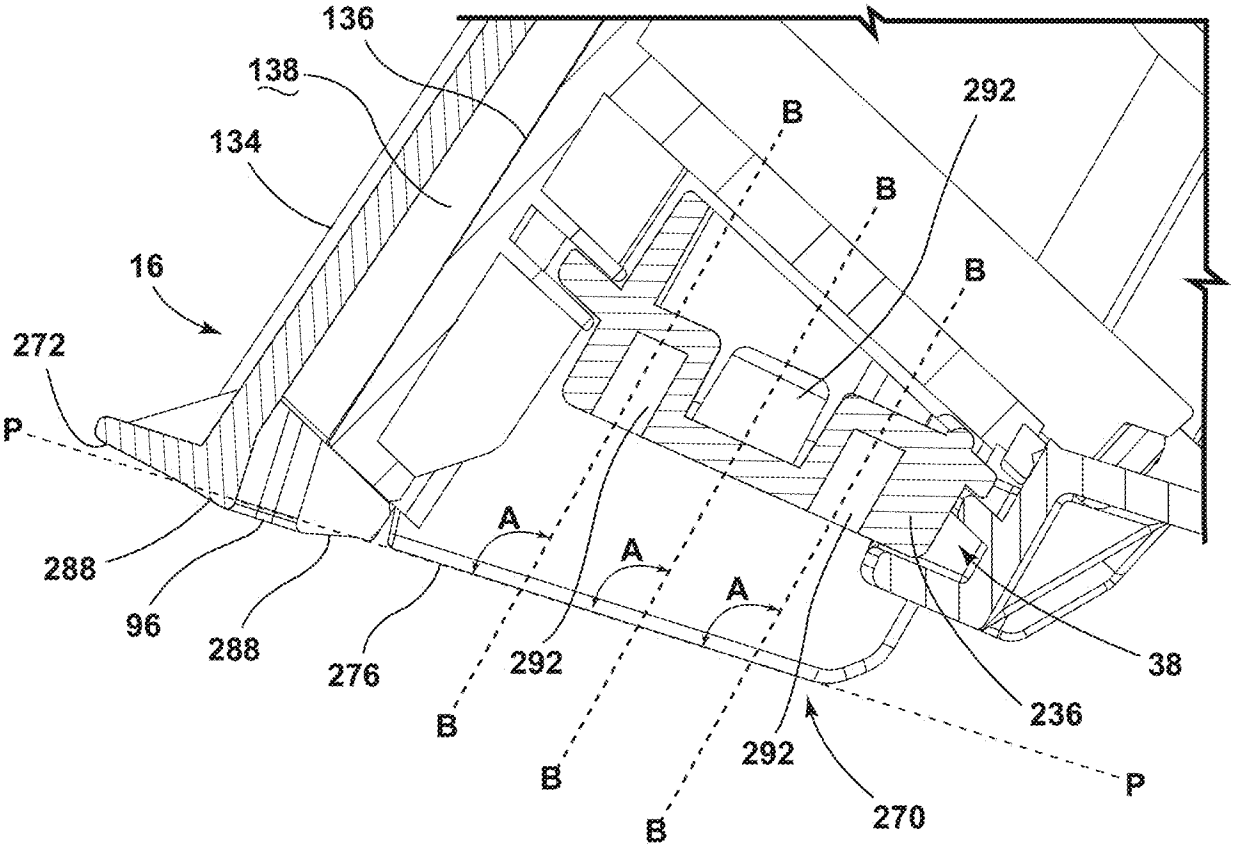
FIG. 25 is a cross-sectional view taken through line XXV-XXV of FIG. 1, showing an orientation of the guide skid relative to an agitator.

Referring to FIGS. 24-25, the side skis 274, 276 may generally lie within a common plane P, thereby being flush with each other. At least a portion of the front ski 272 may lie in the same plane P. In the embodiment shown, the intermediate skis 278, 280 can lie within the plane P, and the front ski 272 may turn upwardly away from the plane P. The peripheral wall 288 surrounding the nozzle inlet 96 extend below the plane P.

The agitation element 240, such as bristles 242, may extend below the guide skid 270, such as with tips 290 of the bristles 242 in particular extending below the side skis 274, 276, e.g. below the plane P. With the guide skid 270 pressed against the surface S, the agitation element 240 can dig into the surface S, providing enhanced scrubbing action.

In certain embodiments, the agitation element 240 is angled with respect to the guide skid 270 so as to resist movement on a forward stroke of the extraction cleaner 10 and to ease the resistance on a backward stroke of the extraction cleaner 10. For example, the agitation element 240 can define an agitation element axis B that intersects the plane P at an oblique angle A. The agitation element axis B can be defined by the bristles 242, a tuft of bristles 242, or a hole 292 supporting a tuft of bristles 242. In the case of the brush 234 shown in FIG. 21, the agitation element axis B can be defined by one of the tines 244, such that at least one of the tines 244, and alternatively multiple tines 244, are disposed at an oblique angle to the plane P, e.g. to the side skids 274, 276.

Referring to FIG. 25, in the embodiment shown, the brush mount 236 includes holes 292 that support tufts of bristles 242 (not shown in FIG. 25 for clarity). At least one of the holes 292, alternatively multiple holes 292, can define the bristle axis B at a center of the hole 292.

To the extent not already described, the different features and structures of the various embodiments of the invention, may be used in combination with each other as desired, or may be used separately. That one handheld extraction cleaner 10 is illustrated herein as having all of these features does not mean that all of these features must be used in combination, but rather done so here for brevity of description. Furthermore, while the extraction cleaner 10 shown herein is handheld, some features of the invention can be useful on a conventional upright or stick cleaner. Still further, the extraction cleaner 10 can additionally have steam delivery capability. Thus, the various features of the different embodiments may be mixed and matched in various extraction cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further aspects of the disclosure are provided by the subject matter of the following clauses:

A handheld extraction cleaner including a unitary body including a carry handle, a supply tank carried by the unitary body, at least one fluid distributor, a working air path through the unitary body, a suction nozzle defining an inlet to the working air path, a suction source in fluid communication with the suction nozzle, a recovery tank including a tank body defining a collection chamber, an inlet opening to the collection chamber, the inlet opening in fluid communication with the suction nozzle, an outlet opening from the collection chamber, and a plug moveable between a closed position in which the plug seals the outlet opening and an open position in which the plug is at least partially spaced from the outlet opening to form a drain path to empty dirty liquid in the recovery tank, a recovery tank receiver provided on the unitary body to mount the recovery tank to the unitary body, and an auto-close feature, wherein the plug is automatically moved to the closed position when the recovery tank is mounted in the recovery tank receiver.

The handheld extraction cleaner according to any preceding clause wherein the plug is slidably mounted in the outlet opening, wherein the plug does not separate from the outlet opening in the open position.

The handheld extraction cleaner according to any preceding clause wherein the suction nozzle and the recovery tank form a modular recovery assembly that is removable from the unitary body as a single module, such that the suction nozzle is removed simultaneously with the recovery tank.

The handheld extraction cleaner according to any preceding clause wherein the modular recovery assembly comprises an agitator disposed rearwardly of the suction nozzle and forwardly of the recovery tank.

The handheld extraction cleaner according to any preceding clause wherein the carry handle and the at least one fluid distributor are separate from the modular recovery assembly so that the modular recovery assembly is removable from the unitary body without removing the carry handle and without removing the at least one fluid distributor.

The handheld extraction cleaner according to any preceding clause wherein the auto-close feature comprises a blocker on a housing of the unitary body that is positioned to push the plug to the closed position as the recovery tank is seated in the tank receiver.

A handheld extraction cleaner including a unitary body including a unitary body including a carry handle, a first lateral side, and a second lateral side, a fluid delivery system including a supply tank carried by the unitary body and at least one fluid distributor, a recovery system including a working air path through the unitary body, a suction nozzle defining an inlet to the working air path, a suction source in fluid communication with the suction nozzle, and a recovery tank carried by the unitary body, and an agitator disposed rearwardly of the suction nozzle and forwardly of the recovery tank, wherein the agitator slides out from the first lateral side of the unitary body.

The handheld extraction cleaner according to any preceding clause comprising an agitator receiver disposed between the suction nozzle and the recovery tank, wherein the agitator slides into and out of the agitator receiver.

The handheld extraction cleaner according to any preceding clause wherein the agitator has a handle to facilitate removal of the agitator from the agitator receiver.

A handheld extraction cleaner including a unitary body including a carry handle, a first lateral side, and a second lateral side, a fluid delivery system including a supply tank carried by the unitary body and at least one fluid distributor, a recovery system including a working air path through the unitary body, a suction nozzle defining an inlet to the working air path, a suction source in fluid communication with the suction nozzle, and a recovery tank carried by the unitary body, an agitator disposed rearwardly of the suction nozzle and forwardly of the recovery tank, and a cleaning angle guide skid to orient the extraction cleaner at a predetermined cleaning angle for efficient extraction with respect to a surface to be cleaned.

The handheld extraction cleaner according to any preceding clause wherein the cleaning angle guide skid comprises a front ski and side skis behind the front ski, the front ski extending across a front of the suction nozzle and substantially the width of a nozzle inlet of the suction nozzle, and the side skis extending rearwardly of the nozzle inlet and disposed on either side of an agitation element of the agitator.

A handheld extraction cleaner including a unitary body including a carry handle, a recovery system including a working air path through the unitary body, a suction nozzle defining an inlet to the working air path, a suction source in fluid communication with the suction nozzle, and a recovery tank carried by the unitary body, and a fluid delivery system including a supply tank carried by the unitary body and at least one fluid distributor, wherein the supply tank is a non-removable part located within a housing of the unitary body, and wherein an exposed portion of the supply tank forms an exterior surface of the extraction cleaner, the exposed portion of the supply tank comprising a viewing window that permits a user to ascertain the liquid fill level inside the supply tank.

The handheld extraction cleaner according to any preceding clause wherein the housing partially wraps around the supply tank while leaving a portion of the supply tank exposed to form the exposed portion.

The handheld extraction cleaner according to any preceding clause wherein the handheld extraction cleaner includes a vacuum motor, wherein the supply tank is located rearwardly of the recovery tank, the vacuum motor, and the carry handle.

The handheld extraction cleaner according to any preceding clause wherein the supply tank has a pivotable fill cap disposed at a rearward end of the carry handle.

The handheld extraction cleaner according to any preceding clause wherein supply tank is located rearwardly of one or more of the suction nozzle, an agitator, a pump, and a battery.

What is claimed is:

1. A handheld extraction cleaner, comprising:

a unitary body including a carry handle;

a fluid delivery system comprising a supply tank on the unitary body and at least one fluid distributor;

a recovery system comprising a working air path through the unitary body, a suction nozzle comprising a nozzle inlet defining an inlet to the working air path, a suction source in fluid communication with the suction nozzle, and a recovery tank on the unitary body;

an agitator provided on a bottom of the unitary body, the agitator disposed rearwardly of the suction nozzle and forwardly of the recovery tank; and a cleaning angle guide skid to orient the extraction cleaner at a predetermined cleaning angle for extraction with respect to a surface to be cleaned.

2. The handheld extraction cleaner of claim 1, wherein the predetermined cleaning angle is at least one of:

an angle at which the nozzle inlet is flat adjacent to the surface to be cleaned;

an angle at which the nozzle inlet is flat against the surface to be cleaned; and an angle at which the nozzle inlet is sealed with the surface to be cleaned.

3. The handheld extraction cleaner of claim 1, wherein the guide skid comprises a front ski and at least one side ski behind the front ski.

4. The handheld extraction cleaner of claim 3, wherein the front ski extends across a front of the suction nozzle and extends substantially a width of the nozzle inlet.

5. The handheld extraction cleaner of claim 4, wherein the at least one side ski extends rearwardly of the nozzle inlet and is disposed laterally outward of an agitation element of the agitator.

6. The handheld extraction cleaner of claim 3, wherein the front ski is elongated in a first direction and the at least one side ski is elongated in a second direction that is transverse to the first direction.

7. The handheld extraction cleaner of claim 3, wherein:

the suction nozzle comprises a front cover and a rear cover defining a suction pathway therebetween, and an opening forming the nozzle inlet at a lower end of the suction pathway; and the front ski projects from a forward edge of the front cover.

8. The handheld extraction cleaner of claim 3, wherein the front ski comprises a contact surface that is flush with a contact surface of the at least one side ski such that the contact surfaces lie within a plane, wherein the agitator comprises an agitation element defining an agitation element axis that intersects the plane at an oblique angle.

9. The handheld extraction cleaner of claim 1, wherein the guide skid comprises a front ski, a first side ski behind the front ski, and a second side ski behind the front ski.

10. The handheld extraction cleaner of claim 9, wherein:

the front ski extends across a front of the suction nozzle;

the first and second side skis extend rearwardly of the nozzle inlet; and the first and second side skis are disposed laterally outward of and on opposing sides of an agitation element of the agitator.

11. The handheld extraction cleaner of claim 9, wherein:

the unitary body comprises a housing having a first lateral side and a second lateral side;

the first side ski is on the first lateral side of the housing, and projects laterally outwardly of a first exterior side surface of the suction nozzle; and the second side ski is generally on the second lateral side of the housing, and projects from a second exterior side surface of the suction nozzle that is diametrically opposed to the first exterior side surface.

12. The handheld extraction cleaner of claim 11, wherein the agitator is removable from the unitary body, and wherein the agitator is slidable through the first lateral side of the unitary body to remove the agitator from the unitary body.

13. The handheld extraction cleaner of claim 9, wherein the guide skid comprises:

a first intermediate ski bridging a gap between the front ski and the first side ski; and a second intermediate ski bridging a gap between the front ski and the second side ski;

wherein the first and second intermediate skis extend alongside lateral ends of the nozzle inlet.

14. The handheld extraction cleaner of claim 13, wherein:

the suction nozzle comprises a front cover and a rear cover defining a suction pathway therebetween, with an opening forming the nozzle inlet at a lower end of the suction pathway; and the front ski, the first intermediate ski, and the second intermediate ski are defined by bottom surfaces of the front cover.

15. The handheld extraction cleaner of claim 1, comprising an agitator receiver disposed between the suction nozzle and the recovery tank, wherein the agitator is removable from the agitator receiver and comprises a handle to facilitate removal of the agitator from the agitator receiver, and wherein the handle forms a portion of the guide skid.

16. The handheld extraction cleaner of claim 1, comprising an inclined peripheral wall surrounding the nozzle inlet, the inclined peripheral wall extending from the guide skid downwardly and inwardly toward the nozzle inlet.

17. The handheld extraction cleaner of claim 1, wherein the guide skid extends around at least one of the nozzle inlet and the agitator.

18. The handheld extraction cleaner of claim 17, wherein the guide skid extends across a front of the suction nozzle and includes portions extending rearward from the front of the suction nozzle on opposing lateral sides of the nozzle inlet and on opposing lateral sides of an agitation element of the agitator.

19. The handheld extraction cleaner of claim 1, wherein the agitator comprises an agitation element that extends below the guide skid.

20. The handheld extraction cleaner of claim 1, wherein at least the suction nozzle, the recovery tank, the agitator, and the guide skid form a modular recovery assembly that is removable from the unitary body as a single module, such that the suction nozzle is removed simultaneously with the agitator and with the recovery tank, wherein the carry handle is separate from the modular recovery assembly so that the modular recovery assembly is removable from the unitary body without removing the carry handle.

* * * * *